US008032952B2

(12) United States Patent
Plut

(10) Patent No.: US 8,032,952 B2
(45) **Date of Patent: *Oct. 11, 2011**

(54) PROTECTIVE APPAREL WITH IMPROVED DISPOSAL

(75) Inventor: William J. Plut, Menlo Park, CA (US)

(73) Assignee: Honeywood Technologies, LLC, Menlo Park, CA (US)

( * ) Notice: Subject to any disclaimer, the term of this patent is extended or adjusted under 35 U.S.C. 154(b) by 499 days.

This patent is subject to a terminal disclaimer.

(21) Appl. No.: 11/356,866

(22) Filed: Feb. 18, 2006

(65) Prior Publication Data

US 2006/0277667 A1 Dec. 14, 2006

(51) Int. Cl.
*A41D 13/00* (2006.01)

(52) U.S. Cl. ..... 2/456

(58) Field of Classification Search ..... 2/456, 457, 2/46, 69, 93, 94, 173, 424, 81, 84, 85, 901, 2/171, 202, 206, 49

See application file for complete search history.

(56) References Cited

U.S. PATENT DOCUMENTS 3,389,407 A * 6/1968 Morrison ..... 2/84
3,525,334 A 8/1970 Braman
3,955,570 A 5/1976 Hutter, III
4,055,173 A 10/1977 Knab
4,214,320 A 7/1980 Belkin
4,255,818 A 3/1981 Crowley
4,336,799 A 6/1982 Almasi
4,382,303 A 5/1983 Lunt
4,384,370 A 5/1983 Singer
4,494,245 A 1/1985 Burkhead
4,504,977 A 3/1985 King
4,504,978 A 3/1985 Gregory, Jr.
4,523,335 A 6/1985 Scrivens
4,535,481 A 8/1985 Ruth-Larson
4,586,196 A 5/1986 White
4,651,727 A 3/1987 Howorth
4,653,120 A 3/1987 Leaf
4,670,073 A 6/1987 Langley
4,674,132 A 6/1987 Stein
4,676,236 A 6/1987 Piorkowski
4,677,696 A 7/1987 Tanaka
4,683,593 A 8/1987 Langley (Continued)

OTHER PUBLICATIONS

Office Action in U.S. Appl. No. 10/888,442 dated Jun. 30, 2009.

(Continued)

*Primary Examiner* — Tejash Patel

(57) ABSTRACT

Described herein is apparel that protects a wearer from an undesirable agent. The apparel employs a transition portal to assist doffing and to reduce the risk of cross-contamination during doffing. The transition portal attaches to the apparel proximate to one end of an aperture, which provides an exit for the protective apparel. When doffing, the transition portal extends away from the person, who exits the aperture. The transition portal is then pulled over the body along with any attached portions of the protective apparel. This turns the transition portal—and attached parts of the apparel—inside-out. After doffing, most portions of protective apparel are either a) inside-out, or b) contained within the inside-out transition portal and/or apparel. As a result, undesirable agents—that were initially on the outside of the apparel—are now inside the inside-out transition portal and apparel. In one embodiment, the transition portal is carried internal to the apparel so that surfaces of the portal are not exposed to the external environment and undesirable agent. After doffing, the transition portal may also be used as a large 'garbage bag' into which the apparel is placed for disposal.

12 Claims, 11 Drawing Sheets

U.S. PATENT DOCUMENTS

| | | | | |
|---|---|---|---|---|
| 4,864,654 | A | | 9/1989 | Schriver |
| 4,910,803 | A | | 3/1990 | Cukier |
| 4,935,260 | A | | 6/1990 | Shlenker |
| 4,937,881 | A | | 7/1990 | Heise |
| 4,951,662 | A | | 8/1990 | Townsend, Jr. |
| 4,969,215 | A | | 11/1990 | Burkett |
| 4,986,282 | A | | 1/1991 | Stackhouse |
| 5,005,216 | A | | 4/1991 | Blackburn |
| 5,009,225 | A | | 4/1991 | Vrabel |
| 5,033,115 | A | | 7/1991 | Bowling |
| 5,042,474 | A | | 8/1991 | Williamson |
| 5,046,492 | A | | 9/1991 | Stackhouse |
| 5,054,480 | A | | 10/1991 | Bare |
| 5,069,205 | A | | 12/1991 | Urso |
| 5,097,534 | A | | 3/1992 | Viemeister |
| 5,140,980 | A | | 8/1992 | Haughey |
| 5,142,704 | A | | 9/1992 | Viemeister |
| 5,142,706 | A | | 9/1992 | Layhon |
| 5,253,642 | A | | 10/1993 | Stackhouse |
| 5,274,850 | A | * | 1/1994 | Aldridge ..... 2/84 |
| 5,342,121 | A | | 8/1994 | Koria |
| 5,414,867 | A | | 5/1995 | Bowling |
| 5,467,481 | A | | 11/1995 | Srivastava |
| 5,549,104 | A | | 8/1996 | Crump |
| 5,560,974 | A | | 10/1996 | Langley |
| 5,564,123 | A | | 10/1996 | Grassick |
| 5,572,743 | A | | 11/1996 | Yavitz |
| 5,588,153 | A | | 12/1996 | Ignon |
| 5,592,936 | A | | 1/1997 | Thomas, Jr. |
| 5,652,962 | A | | 8/1997 | Patnode |
| 5,655,374 | A | | 8/1997 | Santilli |
| 5,690,095 | A | | 11/1997 | Glynn |
| 5,704,670 | A | | 1/1998 | Surplus |
| 5,711,033 | A | | 1/1998 | Green |
| 5,787,504 | A | * | 8/1998 | Wu ..... 2/93 |
| 5,794,276 | A | | 8/1998 | Walker |
| 5,869,193 | A | | 2/1999 | Langley |
| 5,887,281 | A | | 3/1999 | Green |
| 5,901,376 | A | | 5/1999 | Deirmendjian |
| 5,961,167 | A | | 10/1999 | Gilley |
| 5,991,921 | A | | 11/1999 | Saito |
| 5,991,923 | A | | 11/1999 | Maria |
| 6,014,971 | A | | 1/2000 | Danisch |
| 6,062,444 | A | | 5/2000 | Tankersley |
| 6,062,976 | A | | 5/2000 | De Guzman |
| 6,115,839 | A | | 9/2000 | Covington |
| 6,122,772 | A | | 9/2000 | De Guzman |
| 6,212,690 | B1 | * | 4/2001 | Spangler ..... 2/457 |
| 6,238,767 | B1 | | 5/2001 | McCormack |
| 6,241,134 | B1 | | 6/2001 | Dunkel |
| 6,360,371 | B1 | * | 3/2002 | Davey ..... 2/86 |
| 6,378,136 | B2 | | 4/2002 | Matsushita |
| 6,393,617 | B1 | | 5/2002 | Paris |
| 6,427,883 | B1 | | 8/2002 | Esten |
| 6,481,019 | B2 | | 11/2002 | Diaz |
| 6,564,386 | B2 | | 5/2003 | Fujikawa |
| 6,602,102 | B2 | | 8/2003 | Gines |
| 6,610,163 | B1 | | 8/2003 | Mathis |
| 6,622,311 | B2 | | 9/2003 | Diaz |
| 6,687,919 | B2 | | 2/2004 | Dilworth |
| 6,792,625 | B2 | | 9/2004 | Hexels |
| 6,799,331 | B2 | | 10/2004 | Griesbach, III |
| 2006/0277668 | A1 | | 12/2006 | Plut |
| 2007/0192947 | A1 | | 8/2007 | Plut |

OTHER PUBLICATIONS

Office Action in U.S. Appl. No. 11/357,489 dated Feb. 22, 2007.

* cited by examiner

PROTECTIVE APPAREL WITH IMPROVED DISPOSAL

CROSS-REFERENCE TO RELATED APPLICATIONS

This application claims priority under U.S.C. §120 from co-pending U.S. patent application Ser. No. 10/888,442, filed Jul. 9, 2004 and entitled, "PROTECTIVE APPAREL WITH IMPROVED DOFFING", which is incorporated herein for all purposes and which claimed priority under 35 U.S.C. §119(e) from: U.S. Provisional Patent Application No. 60/486,154 filed Jul. 10, 2003 and from U.S. Provisional Patent Application No. 60/535,363 filed Jan. 9, 2004, each of which is incorporated by reference herein for all purposes.

BACKGROUND OF THE INVENTION

This invention relates to protective apparel. More particularly, the present invention relates to protective apparel that protects a person from an undesirable agent.

Protective apparel is used in many environments that offer an undesirable agent. Surgeons frequently operate on a patient who carries a communicable disease. Recent worldwide outbreaks of severe acute respiratory syndrome (SARS) have required health care practitioners to interact with patients that are knowingly afflicted. Practitioners in medical environments such as these are prone to contamination from airborne, blood-borne and droplet-transmitted biological agents. Industrial and chemical environments also offer a variety of airborne, liquid and solid hazards.

Many individuals wear protective apparel in defense of an undesirable agent. Full body suits are common, as are open-bottom gowns provide that frontal coverage and include sleeves to protect the wearer's arms. Gloves, such as disposable latex gloves, are regularly worn with the apparel.

When doffing, apparel users are susceptible to cross-contamination. Cross-contamination occurs when a contaminated part of the apparel contacts an unprotected portion of a person's skin or clothes. Sequential removal of separate apparel parts may lead to circumstances that pose cross-contamination risks. For example, doffing gloves commonly leads to removal and handling of a contaminated second glove by a bare hand. Subsequently, the cross-contaminated hand may be inadvertently used to rub an eye, nose or mouth. Cross-contamination during doffing significantly increases practitioner exposure to the undesirable agent.

Based on the foregoing, it should be apparent that alternative protective apparel would be desirable.

SUMMARY OF THE INVENTION

The present invention relates to protective apparel that employs a transition portal to assist doffing and to reduce the risk of cross-contamination during doffing. The transition portal attaches to the apparel proximate to one end of an aperture, which provides an exit for the protective apparel. When doffing, the transition portal extends away from the person, who exits the aperture. The transition portal is then pulled over the body along with any attached portions of the protective apparel. This turns the transition portal—and attached parts of the apparel—inside-out. After doffing, most portions of protective apparel are either a) inside-out, or b) contained within the inside-out transition portal and/or apparel. As a result, undesirable agents—that were initially on the outside of the apparel—are now inside the inside-out transition portal and apparel. In one embodiment, the transition portal is carried internal to the apparel so that surfaces of the portal are not exposed to the external environment and undesirable agent.

After doffing, the transition portal may also be used into a large 'garbage bag' into which the apparel is placed. Parts within the apparel may be stuffed into the transition portal or inside-out portions of the apparel to assist disposal. After doffing and turning the portal inside-out, outer surfaces of the transition portal are relatively free of any undesirable agents, thereby facilitating handling and disposal of contaminated apparel. The present invention is thus well suited for use with disposable protective apparel that is used once and discarded.

Protective apparel of the present invention finds wide use in shielding a wearer from an undesirable agent. There are numerous applications in which a health-care practitioner or another individual benefits from protective apparel that is used to shield the person from a biological or chemical agent. For example, health care practitioners treating individuals that generate an airborne or droplet-based biological agent, such as a virus associated with a respiratory illness (e.g., the virus believed to be responsible for SARS), may benefit from full coverage protective apparel. Alternatively, surgeons and other surgical staff in an operating room may rely on defense provided by protective apparel described herein against a gaseous or liquid agent.

In one aspect, the present invention relates to apparel for protecting a person from an undesirable agent. The apparel comprises a body portion for covering at least a portion of a person's torso when the person wears the apparel. The apparel also comprises a first sleeve for receiving a portion of a right arm of the person, and a second sleeve for receiving a portion of a left arm of the person. The apparel further comprises a hood that includes a viewing window configured to rest in front of the person's face when the person wears the apparel. The apparel additionally comprises a transition portal including a flaccid material that defines an aperture. The transition portal is designed or configured to allow the person to doff the apparel without physical contact between the person and a surface of the apparel that was external during usage of the apparel.

In another aspect, the present invention relates to apparel for protecting a person from an undesirable agent. The apparel comprises a body portion for covering at least a portion of a person's torso when the person wears the apparel, a first sleeve for receiving a portion of a right arm of the person, and a second sleeve for receiving a portion of a left arm of the person. The apparel also comprises a hood that includes a viewing window configured to rest in front of the person's face when the person wears the apparel. The apparel further comprises a transition portal including a flaccid material. The flaccid material defines an aperture sized such that the person may fit through the aperture, defines a proximate aperture end disposed where the transition portal attaches to shroud material included in the body portion, and defines a distal aperture end that extends away from the body portion.

In yet another aspect, the present invention relates to apparel for protecting a person from an undesirable agent. The apparel comprises a body portion for covering at least a portion of a person's torso when the person wears the apparel. The apparel also comprises a first sleeve for receiving a portion of a right arm of the person. The apparel further comprises a second sleeve for receiving a portion of a left arm of the person. The apparel additionally comprises a transition portal arranged in a groin area of the body portion and including a flaccid material. The flaccid material defines an aperture sized such that the person may fit through the aperture. The flaccid material also defines a proximate aperture end disposed where the transition portal attaches to shroud material included in the apparel about the entire perimeter of the aperture at the proximate aperture end. The flaccid material also defines a distal aperture end that extends away from the body portion.

In still another aspect, the present invention relates to protection apparel. The apparel comprises a body portion for covering at least a portion of a person's torso when the person wears the apparel. The apparel also comprises a sleeve for receiving a portion of a right arm of the person, and a second sleeve for receiving a portion of a left arm of the person. The apparel further comprises a transition portal including a flaccid material that defines an aperture, a first aperture end and a second aperture end. The first aperture end is disposed at a first end of the transition portal where the transition portal attaches to a portion of shroud material included in the apparel. The transition portal is sized such that it may contain the protection apparel for disposal.

The transition portal may also include a drawstring, disposed perimetrically about the second aperture end, which allows the person to change aperture size for the second aperture end.

In another aspect, the present invention relates to a method of doffing apparel that protects a person from an undesirable agent. The method comprises opening an aperture between an environment internal to the apparel and an environment external to the apparel. The aperture is sized such that the person may fit through the aperture. The method also comprises doffing the apparel through the aperture while minimizing physical contact between the person and an outside surface of the apparel In yet another aspect, the present invention relates to apparel for protecting a person from an undesirable agent. The apparel comprises means for covering at least a portion of a person's torso when the person wears the apparel. The apparel also comprises means for receiving a portion of a right arm of the person. The apparel further comprises means for receiving a portion of a left arm of the person. The apparel additionally comprises means for means for releasing a transition portal that was stored internal to the apparel while the person wore the apparel. The aperture is sized such that the person may fit through the aperture. The apparel also comprises means for doffing the apparel through the aperture while minimizing physical contact between the person and an outside surface of the apparel.

In still another aspect, the present invention relates to apparel for protecting a person from an undesirable agent. The apparel comprises a body portion for covering at least a portion of a person's torso when the person wears the apparel. The apparel also comprises a first sleeve for receiving a portion of a right arm of the person. The apparel further comprises a second sleeve for receiving a portion of a left arm of the person. The apparel additionally comprises a transition portal including a flaccid material. The flaccid material defines an aperture sized such that the person may fit through the aperture, defines a proximate aperture end disposed where the transition portal attaches to shroud material included in the apparel, and defines a distal aperture end that extends away from the body portion. The apparel also comprises a compartment sized to store the transition portal while the person wears the apparel. The apparel further comprises an openable flap that covers the compartment when the transition portal is stored.

In still another aspect, the present invention relates to a method of disposing of protective apparel. The method comprises releasing a transition portal from a storage compartment included in the apparel. The transition portal includes flaccid material and is sized such that it may contain the protection apparel for disposal. The method also comprises containing one or more portions of the apparel within the transition portal after the apparel is doffed. The method further comprises disposing of the apparel while it is contained in the transition portal.

In another aspect, the present invention relates to a method of using apparel that protects a person from an undesirable agent. The method comprises positioning a hood of the apparel such that a portion of a viewing window included in the hood is arranged in front of the person's face when the person wears the apparel. The method also comprises wearing the apparel in an environment that potentially offers the undesirable agent. The method further comprises releasing a transition portal that was stored internal to the apparel while the person wore the apparel. The transition portal comprises flaccid material that defines an aperture. The aperture is sized such that the person may fit through the aperture. The method additionally comprises doffing the apparel through the aperture while minimizing physical contact between the person and an outside surface of the apparel.

In yet another aspect, the present invention relates to a method of protecting a person from an undesirable agent. The method comprises assembling apparel that includes a body portion for covering at least a portion of the person's torso when the person wears the apparel, a sleeve for receiving a portion of a portion of a right arm of the person, and a second sleeve for receiving a portion of a portion of a left arm of the person. The method also comprises attaching a transition portal to the body portion. The transition portal includes an aperture and is designed or configured to allow the person to doff the apparel without physical contact between the person and an outside surface of the apparel.

In still another aspect, the present invention relates to protection apparel. The apparel comprises a body portion for covering at least a portion of a person's torso when the person wears the apparel. The apparel also comprises a sleeve for receiving a portion of a right arm of the person. The apparel further comprises a second sleeve for receiving a portion of a left arm of the person. The apparel additionally comprises a first identifier that differentiates between inside surfaces of the sleeves and body portion and outside surfaces of the sleeves and body portion. The apparel additionally comprises a transition portal including a flaccid material that defines an aperture. The transition portal is designed or configured to allow the person to doff the apparel without physical contact between the person and an outside surface of the apparel.

In another aspect, the present invention relates to protection apparel. The apparel comprises a body portion for covering at least a portion of a person's torso when the person wears the apparel, a sleeve for receiving a portion of a right arm of the person, and a second sleeve for receiving a portion of a left arm of the person. The apparel also comprises a hood that includes a viewing window configured to rest in front of the person's face when the person wears the apparel. The apparel further comprises a first color disposed on inside surfaces of the body portion and sleeves and a second color disposed on outside surfaces of the body portion and sleeves.

In yet another aspect, the present invention relates to a method of doffing protective apparel. The method comprises releasing a transition portal that was stored internal to the apparel while the person wore the apparel. The transition portal comprises flaccid material that defines an aperture and the aperture is sized such that the person may fit through the aperture. The method also comprises handling an inside surface of the body portion or one of the sleeves that is marked with a color that differentiates an inside surface of the body portion and sleeves from an outside surface of the body portion and sleeves. The method further comprises doffing the apparel through the aperture while minimizing physical contact between the person and an outside surface of the apparel.

In still another aspect, the present invention relates to a method of doffing apparel that protects a person from an undesirable agent. The method comprises releasing a transition portal that was stored internal to the apparel while the person wore the apparel. The transition portal comprises flaccid material that defines an aperture. The aperture is sized such that the person may fit through the aperture. The method also comprises doffing the apparel through the aperture while minimizing physical contact between the person and an outside surface of the apparel.

These and other features of the present invention will be presented in more detail in the following detailed description of the invention and the associated figures.

Before committing to the Detailed Description, it may facilitate understanding to clarify certain words and phrases used in this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, be bound to or with, have, have a property of, or the like. Support and definitions for certain words and phrases are provided throughout this patent document, and those of ordinary skill in the art should understand that in many, if not most instances, such support applies to prior, as well as future uses of such words and phrases.

DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Protective apparel described herein includes a transition portal that facilitates doffing (and donning). The transition portal is particularly advantageous to protect the wearer from undesirable agents—found on outside surfaces of the apparel—that pose a risk of cross-contamination during doffing.

As the term is used herein, 'proximate' refers to features or locations that are closer to the torso of the person, while 'distal' refers to features or locations that are further from the torso of the person. Thus, 'distal' for a sleeve related feature refers to features or locations that are closer to fingertips of the person, while 'proximate' refers to features or locations that are closer to shoulders of the person. Similarly, 'distal' for the transition portal described below refers to features or locations that extend away from the person's torso, while 'proximate' refers to features or locations that are closer to the person's torso.

Figure 1:
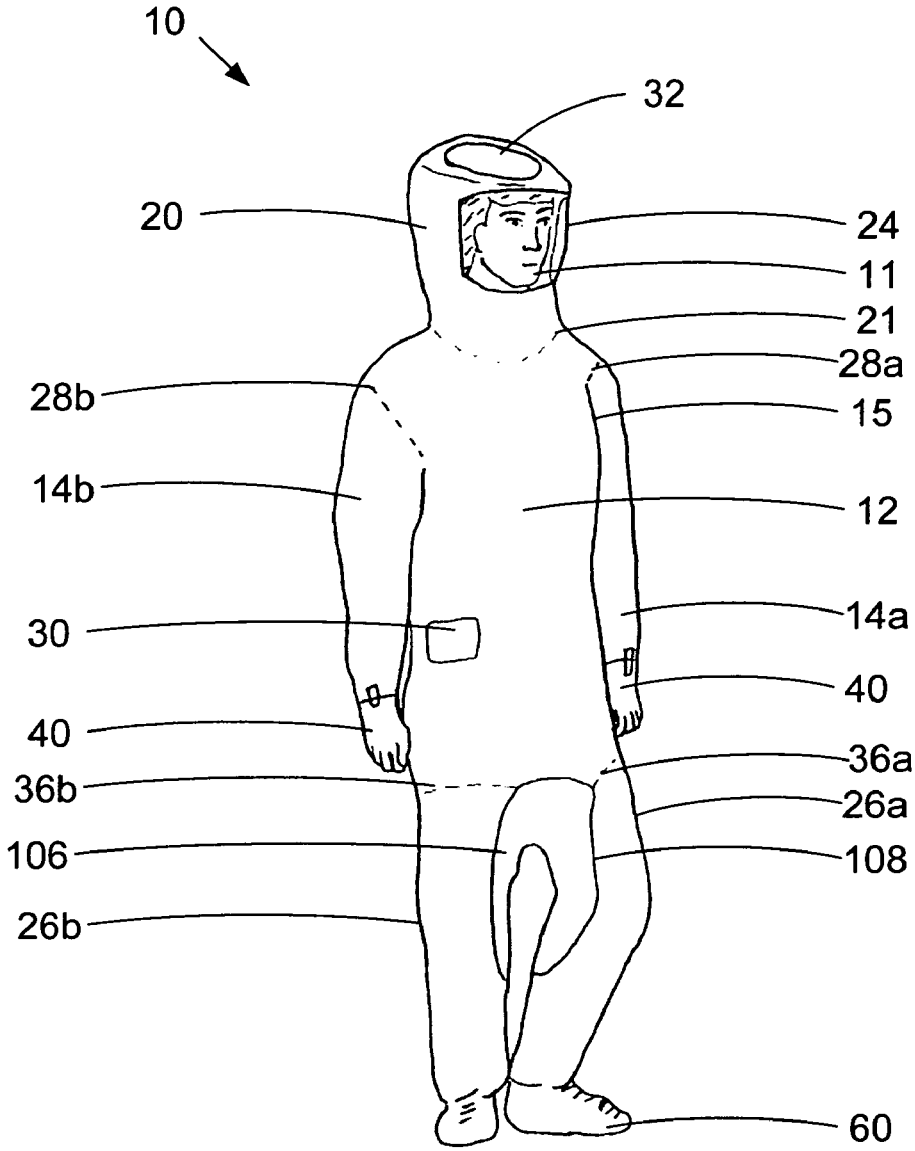
FIG. 1 illustrates a front elevation view of protective apparel in accordance with one embodiment of the present invention.

FIG. 1 illustrates an outer front elevation view of protective apparel 10 in accordance with one embodiment of the present invention. While the present invention will now be described as protective apparel useful for shielding a wearer from an undesirable agent, those skilled in the art will recognize that the subsequent description may also illustrate methods and discrete actions for doffing and protecting a person from an undesirable agent.

Apparel 10 generally refers to a garment assembly for use by a person 11. Apparel 10 comprises multiple components that are attached to form the garment assembly. As shown in FIG. 1, apparel 10 comprises body portion 12, sleeves 14, hood 20, pant legs 26, gloves 40 and boots 60. Apparel 10 also comprises a headgear assembly (FIGS. 2A and 2B) within hood 20, filters 30 and 32, and transition portal (FIGS. 3A-3E). Materials suitable for each component are described below, in addition to description of suitable techniques for attaching the different components. In one embodiment, apparel 10 resembles a garment assembly or full-body suit that covers the entire body of person 12. In this case, apparel 10 creates an environment internal to apparel 10 and separates the internal environment from an environment external to apparel 10. In another embodiment, apparel 10 resembles a gown with an open bottom and no pant legs 26. The open gown may extend to the person's waist, ankles, or any height therebetween. Filters 30 and 32 regulate air and particulate passage through specific portions of apparel 10, while a blower neighbors one of the filters to supply fresh air into apparel 10 for breathing and/or cooling.

Shroud material 15 provides the main physical barrier between the environment internal to apparel 10 and the environment external to apparel 10. Shroud material 15 comprises a relatively thin, flaccid or semi-flaccid sheet. Shroud material 15 is included in most components of apparel 10, such as body portion 12, sleeves 14, pant legs 26, boots 60, and hood 20. In one embodiment, apparel 10 is designed to loosely fit about person 11. In this case, shroud material 15 loosely fits about person 11. In a specific embodiment, apparel 10 employs a single type of material for shroud material 15. In other cases, portions of apparel 10 may include different types of shroud material. For example, body portion 12 may include a substantially liquid impervious material while sleeves 14 include a lighter material that provides lesser protection, while hood comprises a separate material that eases breathing.

In one embodiment to facilitate comfort and thermoregulation for person 11, apparel 10 includes spacers that prevent shroud material 15 and exterior portions of apparel 10 from continuous contact with person 11. Each spacer is arranged on an inner portion of apparel 10 and maintains apparel proximate to the spacer distant from person 11, thereby preventing continuous contact between the person and portions of the apparel. Multiple spacers may form air channels between the spacers, the person and inner portions of the apparel. The channels permit low resistance airflow within the apparel and over the person's body. Low resistance airflow within the channels permits air to be readily moved through the apparel to cool the person. For example, from 4 to 8 spacers may be disposed perimetrically around the person's waist to keep shroud material 15 distant from the person's waist for the entire waist circumference, while from 4 to 8 spacers are disposed perimetrically around the person's chest to keep shroud material 15 distant from the person's chest for the entire chest circumference. Spacers may also be placed on the person's shoulders to form air channels in this region. Further description of spacers and low resistance air flow channels within protective apparel is described in commonly owned patent application entitled "Protective Apparel Spacers", filed on the same day as the present application, and naming William J. Plut as an inventor, which is incorporated by reference herein for all purposes.

Body portion 12 includes shroud material 15 and covers at least a portion of the person's torso. For the embodiment shown in FIG. 1, body portion 12 extends perimetrically about the person's torso and downward from the person's shoulders to below the person's groin, thereby shrouding substantially the full torso. In one embodiment, body portion 12 may extend downward from the shoulders to the waist of person 11, or may extend lower than the waist to the knees, the ankles, a point between the thighs and knees, or a point between the knees and ankles. In one embodiment, body portion 12 includes no seams in the front hemisphere to provide a frontal piece that minimizes risk of penetration from liquid or other undesirable agents at a seam. As mentioned above, apparel 10 may resemble a gown where body portion 12 includes an open bottom and apparel 10 includes no pant legs 26.

Hood 20 substantially covers the wearer's head 85 and neck; and comprises hood shroud material 15 and a viewing window 24. A lower portion of the hood shroud material 15 attaches to an upper portion of body portion 12 at seam 21. Viewing window 24 is configured to rest in front of the person's face when person 11 wears apparel 10. Viewing window 24 allows person 11 to see out of hood 20. Viewing window 24 comprises a thin, lightweight and transparent barrier, such as a suitable plastic. In one embodiment, shroud material 15 included in hood 20 attaches to viewing window 24 about the perimeter of viewing window 24. Shroud material of hood 20 and viewing window 24 may be attached by taping, sewing, or with a suitable adhesive, for example. In one embodiment, shroud material 15 hangs from headgear assembly 80 (FIG. 2B) and viewing window 24 is configured to hang in front of a forward facial section of head 85 when person 11 wears apparel 10. One or more spacers may be attached to a bottom portion of viewing window 24, or to shroud material below viewing window 24, to maintain a distance between the bottom portion of viewing window 24 and person 11. Viewing window 24 may curve about the person's face to increase unobstructed viewing for person 11. In one embodiment, window 24 curves about the person's face and ends in front of the person's ears. In this case, shroud material 15 included in hood 20 is provided with slack such that person 11 may use a stethoscope while wearing apparel 10.

Figure 2A:
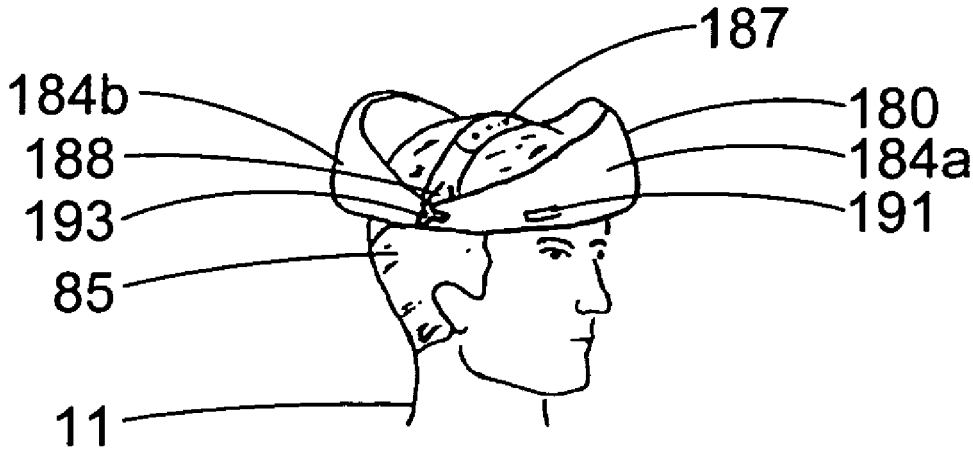
FIG. 2A illustrates a side elevation view of a headgear assembly disposed within the hood of the apparel shown in FIG. 1 in accordance with one embodiment of the present invention.
Figure 2B:
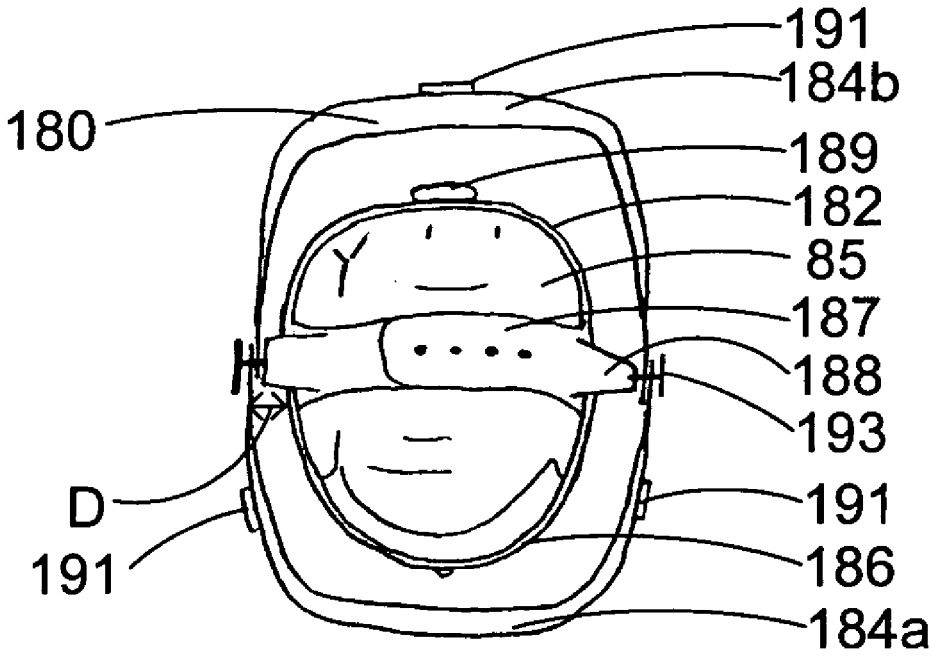
FIG. 2B illustrates a top view of the headgear assembly of FIG. 2A in accordance with one embodiment of the present invention.

FIG. 2A illustrates a side elevation view of a headgear assembly 180 disposed within hood 20 in accordance with one embodiment of the present invention. FIG. 2B illustrates a top view of headgear assembly 180. Headgear assembly 180 rests upon the head 85 of person 11, lies underneath material of hood 20, and maintains shroud material 15 and viewing window 24 at a distance from head 85. Headgear assembly 180 includes a head interface 182 and spacing guards 184.

Head interface 182 comprises a headband 186, support 187 and one or more spacing members 188. Headband 186 circumferentially surrounds head 85 and fits to prevent rotational motion between assembly 180 and head 85. Headband 186 includes an adjustable fastener 189, usually in the back of headband 186, that allows person 11 to change the circumference of headband 86. Fastener 189 may include a ratcheting fastener, a hook and loop fastener (commonly marketed under the trademark name 'Velcro'), or dual arms having mating plastic features that snap together and hold the arms together.

Support 187 attaches to headband 186 on one side of head 85, extends over the top of head 85 when the person wears headgear 180, and attaches to headband 186 on the other side of head 85. Support 187 provides vertical support to bear the weight of headgear assembly 180, shroud material 15 for hood 20, and viewing window 24. Support 187 includes dual arms having mating and adjustable plastic features that allow the person to adjust fit for the top support 187. In one embodiment, support 187 and headband 186 include a slightly compliant material to minimize any localized forces on head 85 and/or a soft padding attached to the underside to increase user comfort (such as foam band or cotton). Although FIG. 2A is illustrated with one support 187 extending over head 85, it is understood that headgear assembly 180 may include a larger number of supports, such as from 2 to 5. In another embodiment, supports 187 comprise a continuous net that extends over the entire head 85 while still allowing for gaseous communication with the top of head 85 for heat dissipation.

Forward spacing guard 184*a* and rear spacing guard 184*b* define the external dimensions of headgear assembly 180. Spacing guards 184 comprise rigid members shaped to contour around the person's head and maintain shroud material 15 from contacting head 85. Spacing guards 184 thus largely define an amount of space between the inner surface of shroud material 15 (or viewing window 24) and head 85 for hood 20. Spacing guards 184 attach to shroud material 15 at one or more places on its perimeter. As shown, male ends of a hook and loop fastener 191 are disposed in three places on spacing guards 184 to attach to mating females pieces on shroud material 15 in hood 20 (not shown). Spacing guards 184 thus position and support hood 20 and bear of the weight of shroud material 15 and viewing window 24. Spacing guards 184 also define the vertical cross-section shape of hood 20 (FIG. 2B). In one embodiment, spacing guards 184 are configured to substantially follow the generally oval contours of the human head. Shroud material 15 drops down from spacing guards 184 according to the contour of spacing guards 184.

Spacing members 188 extend down from support 187 and separate spacing guards 184 laterally from head interface 182. Spacing members 188 maintain spacing guards 184 in position relative to head 85 and thus help establish the amount of space between the inner surface of shroud material 15 and head 85 for hood 20. Spacing members 188 each connect a) at their proximate end to head interface 182, and b) at their distal end to a portion of spacing guards 184. Screws 193 are used to attach spacing guards 184 to each spacing member 188 on either side of the person's head 85. As shown, headgear assembly 180 includes two rigid members 188 symmetrically disposed on opposite sides of head 85. It is understood that a different number of members 188 may be used.

Since shroud material 15 is flaccid and drapes from spacing guards 184, headgear assembly 180 is then configured such that shroud material 15 is spaced above and away from head 85 to provide room for airflow around head 85. Spacing guards 184 also include a height that extends above head 85 to allow for space between material 15 and head 85 above the top of head 85. Thus, neither spacing guards 184 nor shroud material 15 supported by spacing guards 184 continuously contact head 85 during usage of apparel 10. This arrangement permits airflow, breathing circulation and cooling circulation around head 85 with minor resistance. In one embodiment, headgear assembly 180 is dimensioned to maintain an average or minimum distance, D, between shroud material 15 and head 85 (FIG. 2B). An average or minimum distance from about ½ inch to about 4 inches is suitable in some applications. In another embodiment, headgear assembly 80 is dimensioned such that the inner surface of shroud material 15 is, on average or minimum, from about 1 inch to about 2 inches away from head 85. In some cases, slack in shroud material 15 combines with positive pressure from a blower in apparel 10 to expand slack material 15 away from head 85 and thereby create additional space between shroud 15 and head 85. In this case, shroud 15 may rest even further from head 85 than provided passively by headgear assembly 180. Headgear assembly 180 preferably comprises lightweight materials so as to minimize encumbrance on person 11. For example, rigid members 92 may comprise a lightweight and stiff plastic. In a specific embodiment, headgear assembly 180 comprises two Willson V5N series headgear browguards assembled to one V5N series head interface as provided by Bacou Dalloz USA Inc. of Smithfield, R.I.

Returning back to FIG. 1, left and right sleeves 14*a* and 14*b* include shroud material 15 and integrally attach to a shoulder portion of body portion 12 at seams 28*a* and 28*b*, respectively. In another embodiment, the entire front portion of apparel 10 is constructed from a single piece of material and seams 28 do not exist between body portion 12 and sleeves 14 as shown. Sleeve 14*a* receives a left arm of person 11; and left sleeve 14*b* receives a right arm of person 11. While sleeves 14 are illustrated as extending up to the shoulder of person 11, it is understood that different designs and assemblies if apparel 10 will vary the extent of arm coverage provided by each sleeve 14. At the least, each sleeve 14 receives a portion of an arm, such as the forearm to the wrist. Seams 28 connect the separate pieces of shroud material 15 included in body portion 12 and sleeves 14; and may include stitching, tape, an ultrasonic seal and/or a heat seal, depending on the materials being connected and a desired level of protection.

Gloves 40 are worn at the distal end of each arm. In one embodiment, gloves 40 comprise a gaseous and liquid impermeable material such as polyethylene, latex, rubber, or the like. The person may tape or otherwise temporarily attach gloves 40 to sleeves 14. Attaching gloves 40 to sleeves 14 allows person 11 to remove apparel 10 as a single unit, as will be described below. In a specific embodiment, apparel 10 is provided with handwear integrally attached to the distal end of sleeves 14 that facilitates removal of gloves 40 worn over the handwear. The handwear is configured such that when a user doffs the handwear and outer glove 40, the handwear restrains the outer glove 40. Thus, when a user pulls the handwear and outer glove inside-out, the handwear may capture and contain the outer glove, which allows person 11 to remove apparel 10 as a single unit.

Left and right pant legs 26*a* and 26*b* include shroud material 15 and attach to a lower portion of body portion 12 at seams 36*a* and 36*b*, respectively. In another embodiment, the entire front portion of apparel 10 is made from a single piece of material and seams 36 do not exist between body portion 12 and pants legs 26. As shown in FIG. 1, pant legs 26 extend from body portion 12 from the midpoint of the person's thighs. In this case, each pant leg 26 only receives a portion of each leg from the thigh to the foot. As mentioned above, body portion 12 may extend down to a different part of person 11, such as the waist or the knees, which will determine the length of pant legs 26. Extra space within body portion 12 is used to contain and store a collapsible transition portal 100 that facilitates donning and doffing of apparel 10 (FIGS. 3A-3E).

In the embodiment shown in FIG. 1, pant legs 26 extend and enclose the feet or shoes of person 11. Boots 60 attach to the distal ends of each pant leg 26. Boots 60 cover at least a portion of the shoes worn by person 11 and may include an abrasion resistant material on a bottom surface. One or more ties, rubber bands or elastics sewn into shroud material 15 may be used to secure excess material included in boots 60. The excess material assists user entry and exit into and out of boots 60. Plastic tape, hook and loop fasteners, male and females snaps, or other detachable binders may also be used other than ties or elastics to secure excess material of boots 60.

A filter 30 is sewn or otherwise suitably attached to shroud material 15 about a hole in shroud material 15 at a lower area of body portion 12. A blower (not shown) is arranged on the inside of apparel 10 to neighbor inlet filter 30. The blower moves air from the environment external to apparel 10 into the environment internal to apparel 10. Air provided by the blower ventilates the environment internal to apparel 10, cools the person wearing apparel 10 and provides fresh air for breathing. The blower may comprise a fan or other air moving apparatus suitably sized to provide a desired flow rate of air into and/or within apparel 10. Generally, the blower capacity should be sufficient to draw air into apparel 10, through inlet filter 30, and out of apparel 10 at an air flow rate sufficient for respiration and/or cooling of person 11. In one embodiment, an inlet airflow rate from about 5 to about 80 cubic feet per minute (c.f.m.) is suitable. In another embodiment, an inlet airflow rate from about 5 to about 20 c.f.m. is suitable. Larger and smaller airflow rates may be suitable depending on a number of factors, such as the size of apparel 10 and the number of blowers employed. The blower may comprise any conventional fan mechanism and may be powered by a rechargeable battery. Such devices are commercially available from a wide variety of vendors known to those of skill in the art. In a specific embodiment, the blower comprises a D series fan as provided by Pelonis Technologies Inc. of Malvern Pa. In one embodiment, person 11 wears a belt under apparel 10 that supports the blower next to filter 30. In another embodiment, mating hook and loop fasteners are used to attach the blower to shroud material 15 adjacent to filter 30 during usage.

Inlet filter 30 intercepts air before flow into apparel 10 and selectively regulates the passage of air and any particulates in the air, such as any undesirable agents, into apparel 10. In one embodiment, inlet filter 30 comprises a fabric that provides a minimal pressure drop for the blower. The inlet filter 30 material and type may also be varied according to the undesirable agent(s) to be selectively blocked for apparel 10. In another embodiment, inlet filter 30 comprises a sub-micron filter that has an effective porosity such that particles greater than a micron are not permitted to pass through. A HEPA rated filter may also be employed. Such filters are commercially available from vendors known to those skilled in the art. One suitable provider of bacterial and viral filters is Pall Canada Ltd. of Mississauga, Canada.

As shown in FIG. 1, inlet filter 30 is disposed in front of apparel 10 to provide air inlet to the front portion of apparel 10. Alternatively, filter 30 (and the neighboring blower) may be disposed in back of apparel 10, on a side of apparel 10, or in upper portions of apparel 10. In a specific embodiment, filter 30 is located just below a belt (not shown), which allows person 11 to constrict the diameter of apparel 10 about the waist of person 11. In another specific embodiment, filter 30 is located in the upper back region of apparel 10 to allow inlet air to proceed immediately towards hood 20 to facilitate breathing. Apparel 10 may also include multiple inlet filters and blowers, such as a second filter 30 disposed on the backside of apparel 10. In this case, airflow suitable for respiration and cooling may be divided among the multiple inlets.

Air filter 32 exhausts air from an environment internal to apparel 10 to an environment external to apparel 10. Filter 32 is attached material about a hole in the shroud material 15 by sewing, taping, adhesive, etc. As shown in FIG. 1, outlet filter 32 forms a major portion of the top surface of hood 20. In another embodiment, a second filter 32 forms a large fraction of shroud material 15 on the backside of hood 20. Outlet filters 32 may also be included in other portions of apparel 10, such as the top of the person's shoulders, lower or middle regions of body portion 12, in sleeves 14 and/or in pant legs 26.

Inlet filters 30 and outlet filters 32 may be arranged to specifically move air along desired paths within apparel 10 or to draw airflow to a certain area within apparel 10. For example, an inlet filter 30 may be located within or near hood 20 to immediately provide air to this area, while one or more outlet filters are disposed at the waist of apparel 10 (e.g., switch the locations of inlet filter 30 and outlet filter 32 as shown). This arrangement creates a positive pressure about the head 85 and respiratory areas for person 11 and is well-suited for applications that desire positive-pressure respiratory apparel.

Multiple inlet and outlet filters may also be sized and arranged to achieve a desired airflow distribution. In one embodiment, inlet filters 30, associated blowers and outlet filters 32 are arranged such that at least 50 percent of the of inlet air volume fist moves to hood 20 for breathing. In another embodiment, outlet filters 32 in a designated portion of apparel 10 are responsible for at least 50 percent of the of outlet air volume from apparel 10 and the shroud material 15 is breathable and passively exhausts the remainder. In another embodiment, outlet filters 32 are responsible for at least 75 percent of the of outlet air volume from apparel 10.

Inlet and outlet filters may also be configured to direct air for cooling of person 11. Thus, inlet and outlet filters may located and configured to increase airflow and cooling across the torso, neck and head of person 11, which are generally considered priorities for human thermoregulation. For example, air entering an inlet filet 30 in or near hood 20 to increase fresh air supply for breathing may subsequently pass along the body of person 11 for cooling before exhausting from a waist disposed outlet filter 32. In one embodiment, outlet filters 32 comprise the same filter material that is used in inlet filters 30. Correspondingly, brief pressure fluctuations, e.g., those resulting from breathing or movement within apparel 10, do not result in passage of undesirable agents from an environment external to apparel 10 through an intended outlet filter 32 and into the environment internal to apparel 10.

While the present invention has primarily referred to inlet filters that prevent undesirable agents from passing into apparel 10, it is understood that applications such as clean rooms and surgical rooms require apparel and filters that prevent escape of the undesirable agents. In this case, outlet filters 32 selectively transmit air and contaminants moving from the environment internal to the apparel to a clean environment outside the apparel, such as filtering out bacteria and microorganisms carried by person 11 to maintain a sterile zone for surgical applications.

Shroud material 15 typically comprises one or more relatively thin, flaccid sheets. Shroud material 15 forms a large portion of apparel 10 and is included in multiple parts of apparel 10 such as body portion 12, sleeves 14, pant legs 26, boots 60, and hood 20. The number of pieces of material 15 will depend on how apparel 10 is manufactured and assembled, as one skilled in the art will appreciate, and the present invention is not limited to any particular style, assembly or design of apparel 10. Usually, a single type of material is employed for shroud material 15, however, it is contemplated that multiple types of shroud material 15 may be used (e.g., one shroud material 15 for body portion 12 and another shroud material 15 for sleeves 14 and/or hood 20). In one embodiment, shroud material 15 comprises a breathable and selectively filtering material that prevents transmission of a targeted undesirable agent through shroud material 15. In another embodiment, shroud material 15 comprises a substantially air and/or liquid impermeable material, such as a suitable plastic or non-woven fabric. Shroud material 15 may also comprise a breathable or breathable and splash resistant material, such as a non-woven fabric. Breathable portions of material 15 may also operate as a filter for outlet of air from the environment internal to apparel 10 to the environment external to apparel 10. In addition, different materials may be added or combined to shroud material 15 to increase comfort, protection, strength, appearance or another property of apparel 10. For example, plastic materials may be combined with non-woven materials to increase protection. A commercially available material such as one of the Tyvek series as provided by DuPont of Wilmington, Del., is suitable for use in shroud material 15. A non-woven such as one of the Spunbond series as provided by Kimberly-Clark Health Care of Roswell, Ga. may also be suitable. In a specific embodiment, one of ProVent 1000, 3000, 7000, 7500 or 10,000 as provided by Kappler of Guntersville, Ala., is suitable for use. Shroud material 15 may also comprise a material based on polymers and copolymers of vinyl chloride, vinylidene chloride, ethylene, acrylic acids and esters, methacrylic acids and esters, propylene amines such as polyamides and other polymerizable monomers, cotton and silk, compressed nylon, polyester, and/or spandex (which may be used to increase user comfort and fit).

In general, seams of the present invention (such as seam 21 between hood 20 and body portion 12) may include sewing, taping, heat sealing, an adhesive and/or solvent or sonic welding. The specific joining technique used will depend on the two materials being joined, cost, manufacturing ease, and the desired joint strength, as one skilled in the art will appreciate. Multiple joining techniques may also be implemented, such as sewing for seal strength and heat-sealing for seal integrity.

In one embodiment, apparel 10 is airtight except for gaseous communication via inlet filters 30 and outlet filters 32. Apparel 10 then provides an isolated system in which air from the environment external to apparel 10 is transmitted into an environment internal to apparel 10 through inlet filters 30 and out through filters 32. Correspondingly, person 11 is isolated from the ambient environment except through controlled filtering. Air pressure within apparel 10 remains balanced based on the pressure drop across outlet filters 32 and influx pressure provided by the fan or blower. In some cases, apparel 10 is substantially impermeable to one or more undesirable agents. Impermeable as used herein refers to the quality not permitting passage. Thus, "impermeable to air or liquids" refers to a quality of substantially not permitting passage of air or liquids. "Impermeable to an undesirable agent" refers to substantially not permitting passage of the undesirable agent regardless of whether the agent is a solid particulate, gaseous or liquid substance.

Figure 3A:
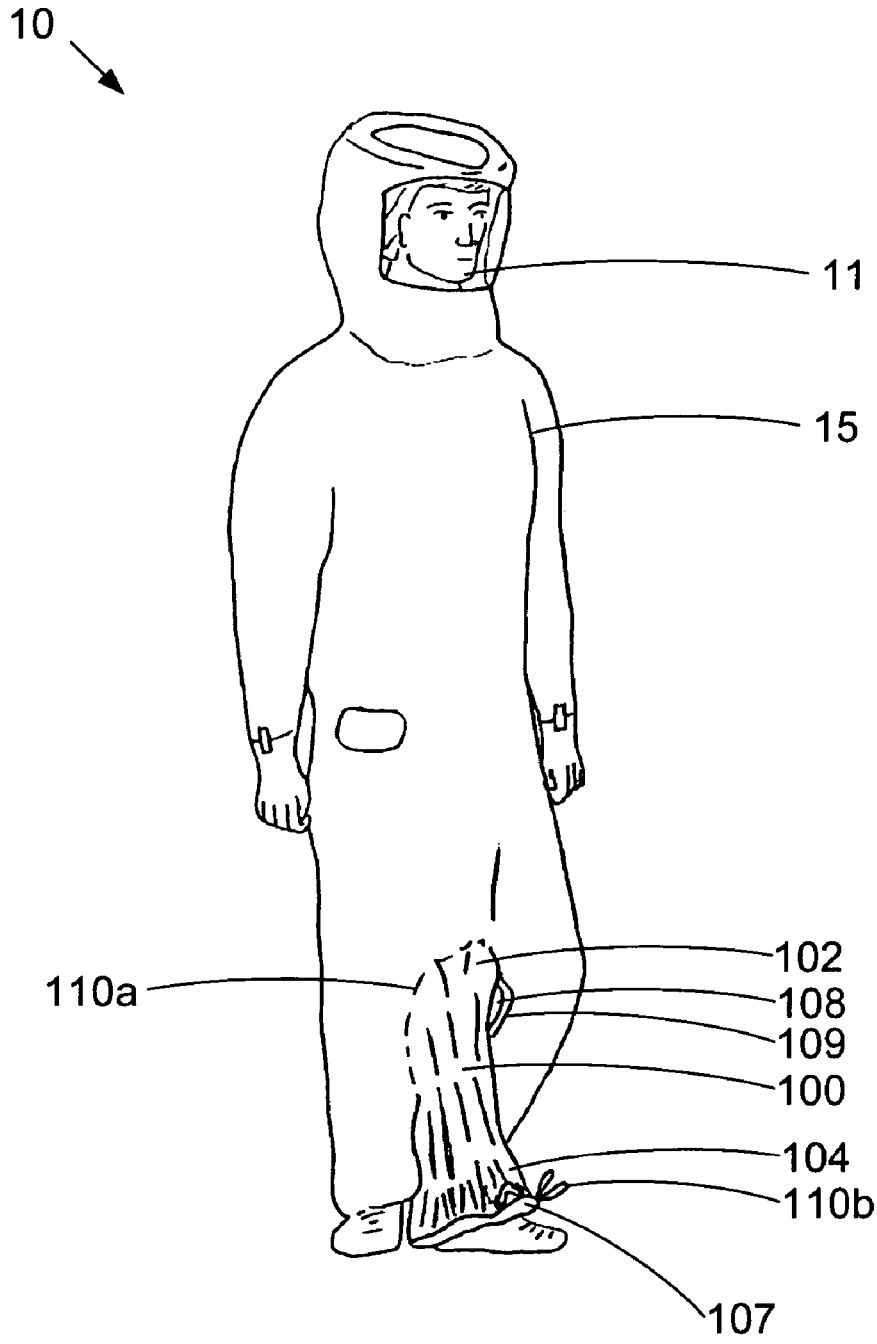
FIG. 3A illustrates a transition portal extended downward from apparel with apertures closed in accordance with one embodiment of the present invention.
Figure 3B:
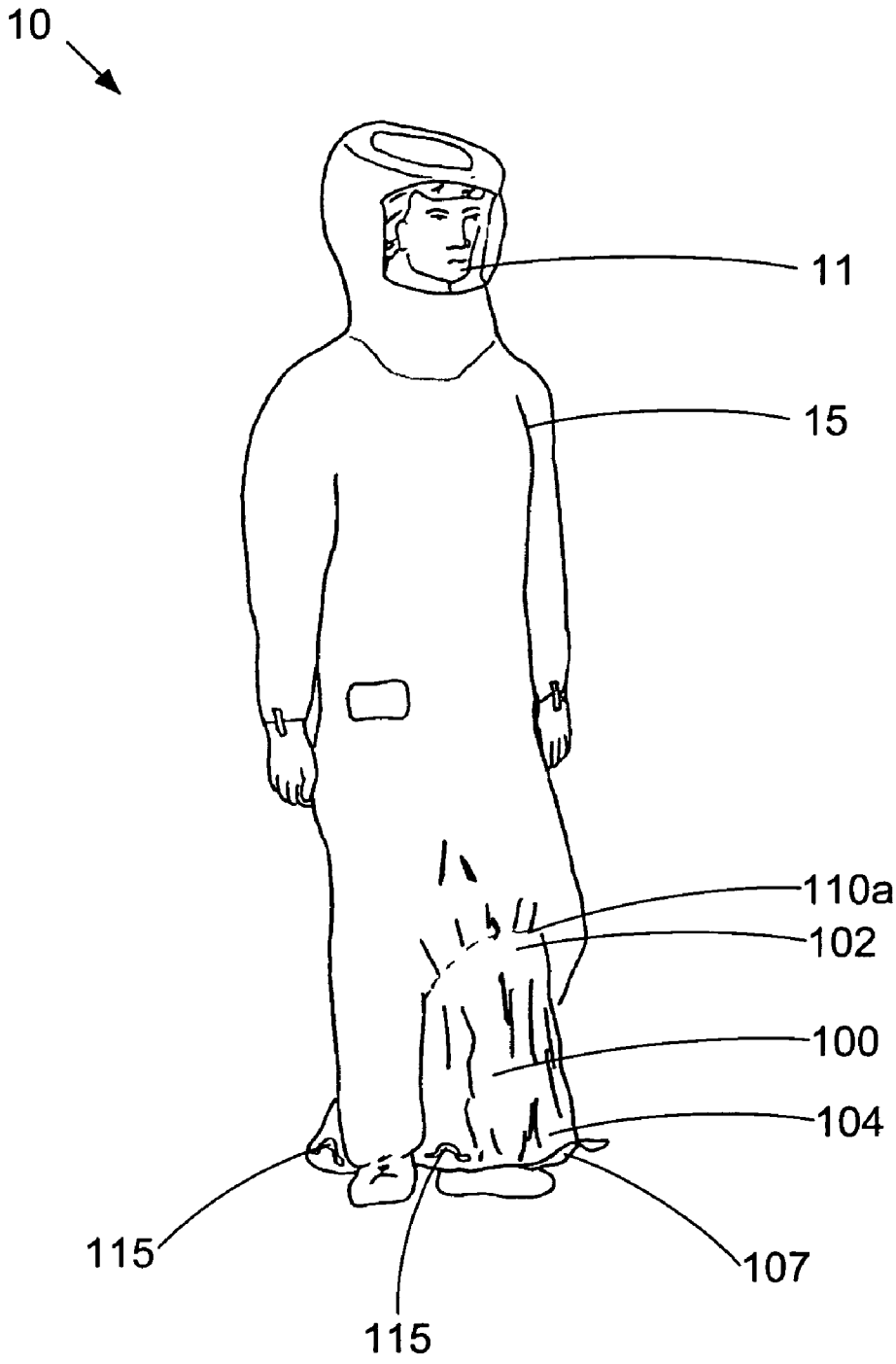
FIG. 3B illustrates the transition portal of FIG. 3A extended downward from apparel with apertures opened.
Figure 3C:
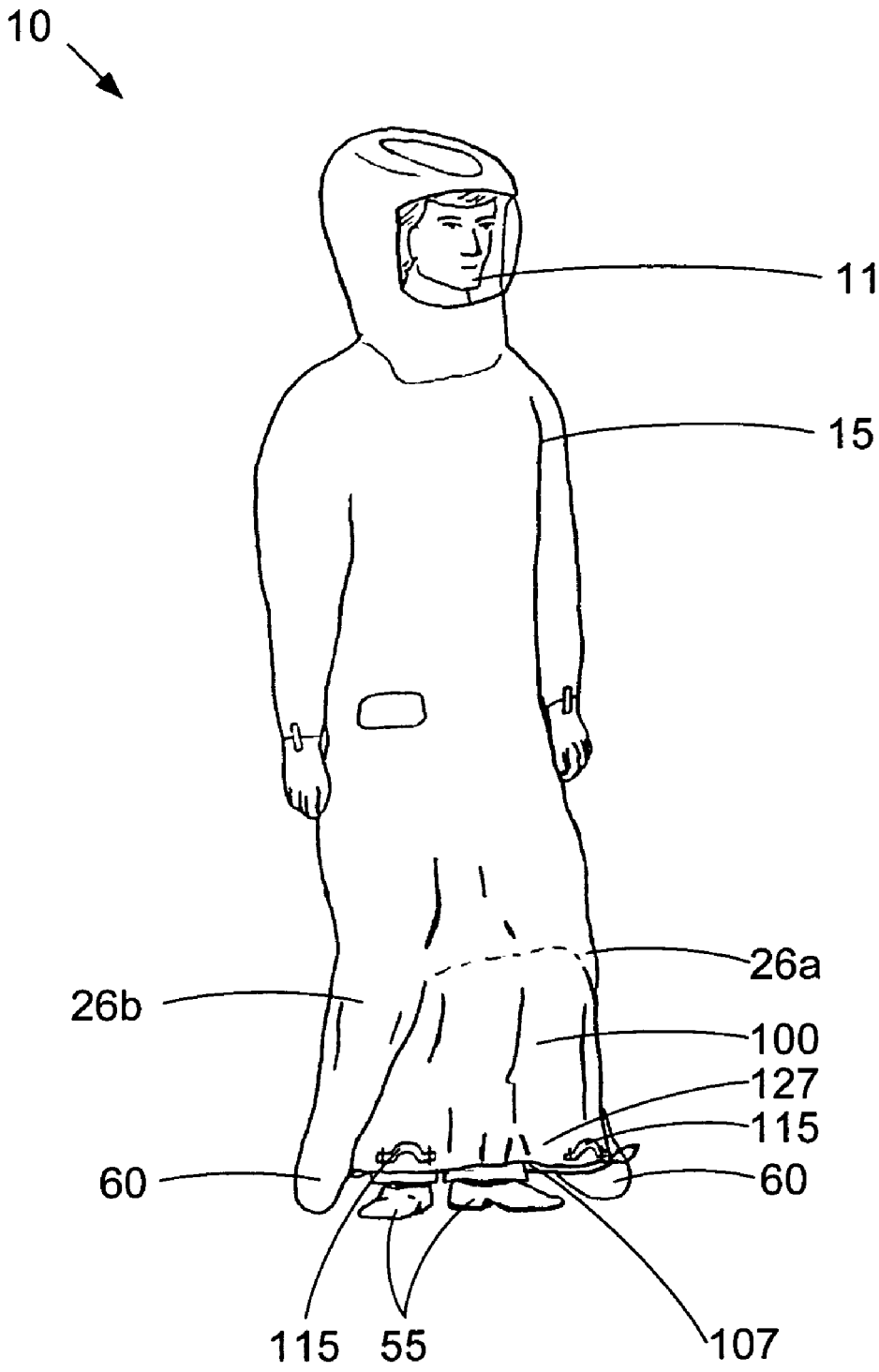
FIG. 3C illustrates a person with his legs in the transition portal of FIG. 3A in preparation for escape from the protective apparel.
Figure 3D:
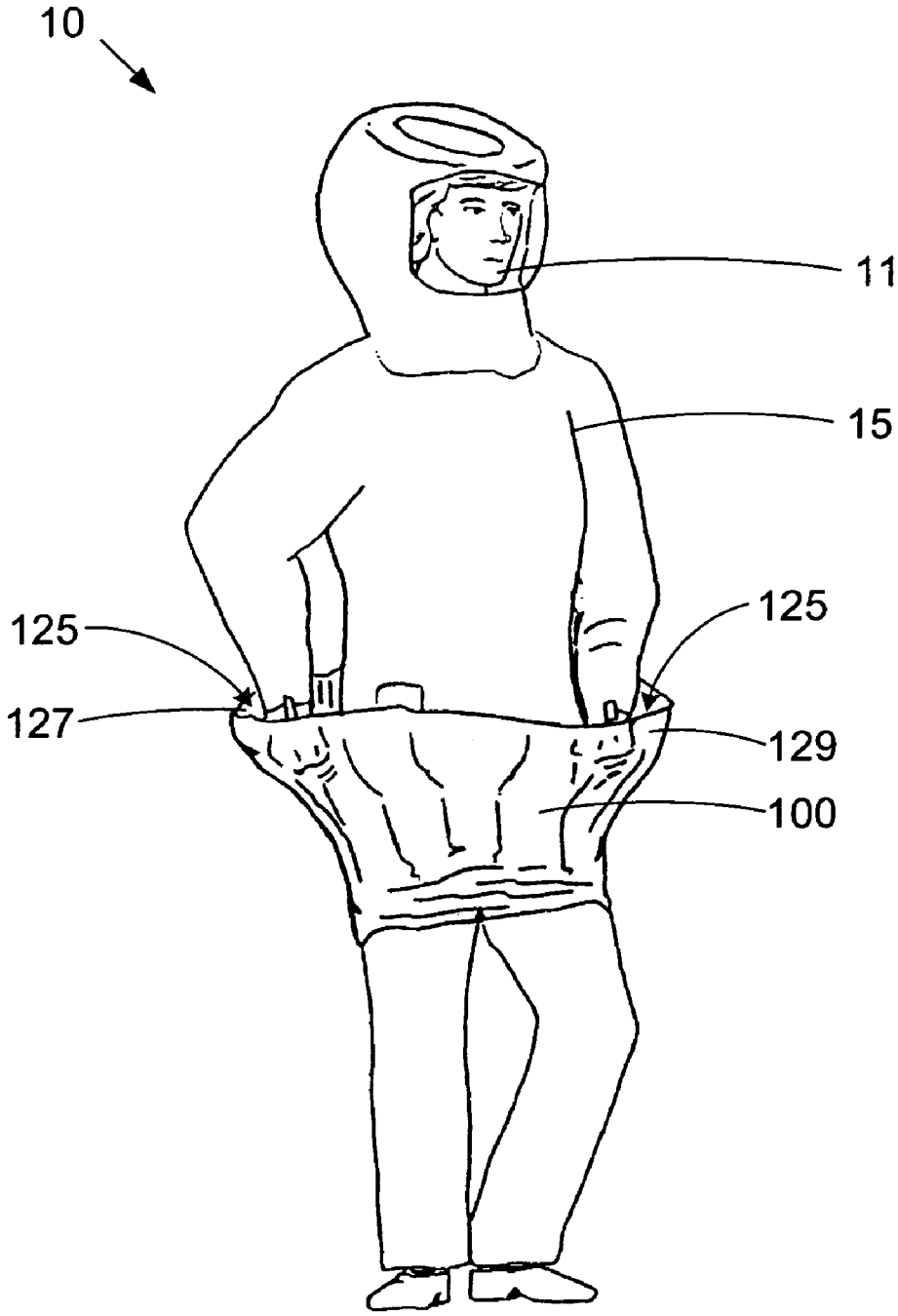
FIG. 3D illustrates the person of FIG. 3C grasping a distal portion of the transition portal and lifting the portal and all attached portions of apparel above the person's waist.
Figure 3E:
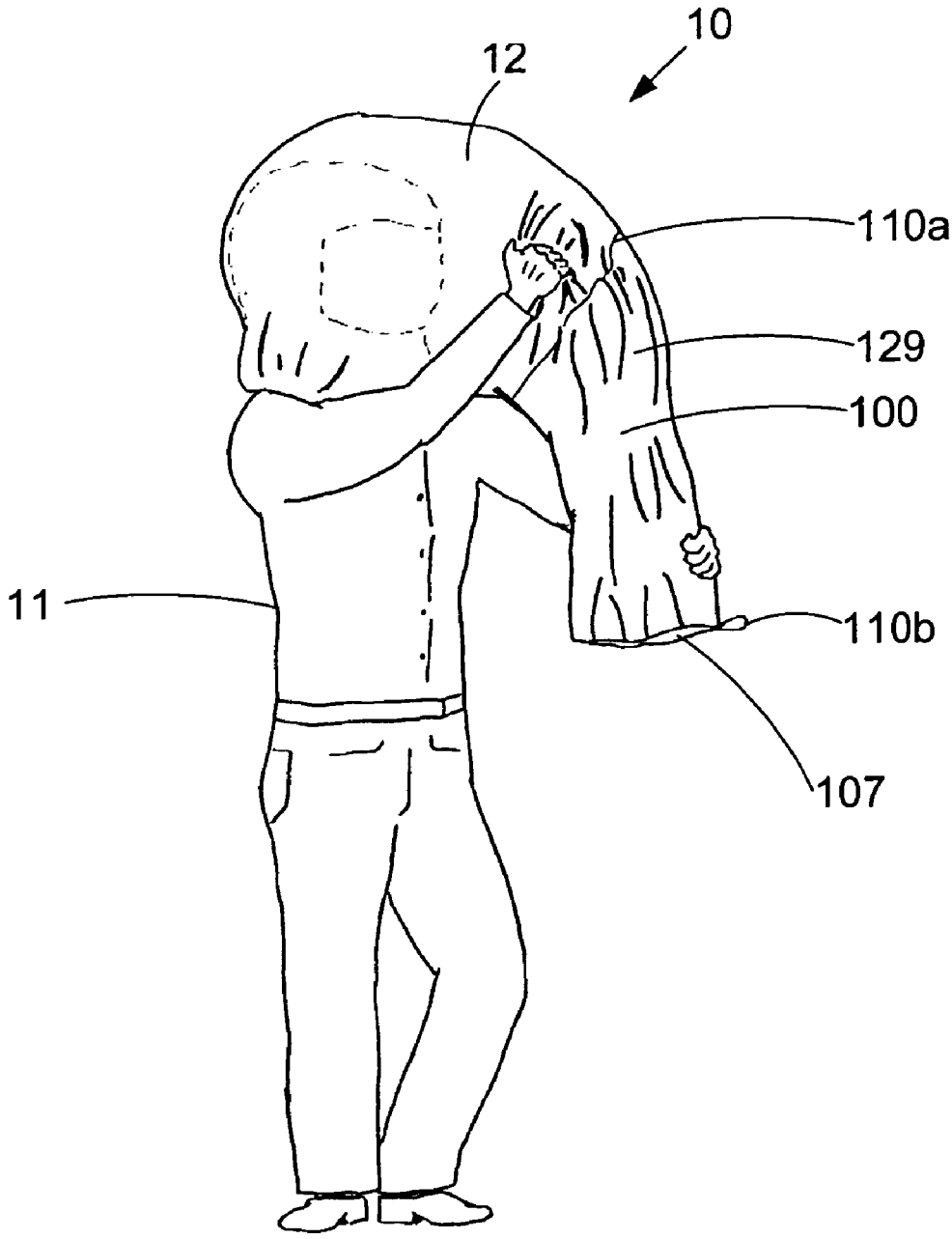
FIG. 3E illustrates the transition portal of FIG. 3C lifted above the person's head and encompassing all of the apparel.

FIGS. 3A-3E illustrate apparel 10 and transition portal 100 in accordance with one embodiment of the present invention. FIG. 3A illustrates transition portal 100 extended downward from apparel 10 with its aperture ends 102 and 104 relatively closed. FIG. 3B illustrates transition portal 100 extended downward from apparel 10 with its aperture ends 102 and 104 relatively opened. FIG. 3C illustrates person 11 with his legs in the transition portal 100 in preparation for doffing through an aperture 107 included in transition portal 100. FIG. 3D illustrates person 11 grasping a distal portion of transition portal 100 and lifting the portal 100 and all attached portions of apparel 10 upwards and above the person's waist. FIG. 3E illustrates transition portal 100 lifted over the person's head.

Initially referring to FIGS. 3A and 3B, a transition portal 100 is shown that permits person 11 to doff apparel 10 without physical contact between person 11 and an outside surface of apparel 10. For the embodiment shown in FIGS. 3A-3E, transition portal 100 is arranged in a groin area of apparel 10.

Transition portal 100 comprises material that defines an aperture 107. Aperture 107 is sized such that person 11 can fit through the aperture. In one embodiment, material used in transition portal 100 is flaccid and conforms to any forces applied thereto. In a specific embodiment, transition portal 100 comprises a flaccid material arranged in a substantially tubular shape. In this case, aperture 107 has the about same size from one end of the flaccid tube to the other end. In another embodiment, the material of transition portal 100 is arranged in a frustoconical shape with the distal end 104 being larger than the proximate end 102. In this case, aperture 107 enlarges from proximate end 102 to distal end 104 and proximate end 102 is sized such that person 11 can fit through the aperture 107 at proximate end 102. It is understood that the size of person 11 may vary. Thus, apparel 10 may be designed for a number of sizes, such as a small, medium and large sizes, in which apparel 10 and aperture 107 are sized to service a range of people sizes. For the embodiment shown in FIG. 3A, a proximate end aperture 107 is defined by the points of attachment between transition portal 100 and shroud material in body portion 15 and legs 26. When released from storage and aperture ends 102 and 104 are opened, transition portal 100 resembles a skirt that is attached to a lower groin area of apparel 10 (FIGS. 3B and 3C). Transition portal 100 may also comprise a stretchable material, such as spandex, that conforms in size to any forces applied thereto. The stretchable material also permits the size of aperture 107 to change.

Transition portal 100 is collapsible. This allows transition portal 100 to be folded, rolled, scrunched or otherwise minimized in size and stored within a storage compartment 106 (as shown in FIG. 1) included in apparel 10 when the transition portal 100 is not in use, e.g., while person 11 wears apparel 10. Storage compartment 106 is sized to store transition portal 100. In one embodiment, space within apparel 10 forms storage compartment 106. As shown in FIG. 1, storage compartment 106 comprises space in a groin region of apparel 10 enclosed by an outer and openable flap 108. Storage compartment 106 may also be included within body portion 12 or one of sleeves 14.

As shown in FIG. 1, flap 108 arches from an inner surface of one pant 26, through the crotch of body portion 12 and to an inner surface of the other pant 26. The inside of flap 108 defines one side of storage compartment 106, which extends below the groin of person 11 and into each pant leg 26. Space within each pant 26 and space between flap 108 and the groin of person 11 thus forms the space for storage compartment 106. Transition portal 100 may then be collapsed and transported within this space, during both packing/storage of apparel 10 before usage and during usage. In another embodiment, a groin positioned flap 108 extends from a back side of apparel 10, under the groin, and attaches to a front and lower portion of body portion 12. Apparel 10 may alternatively include a pocket for storing transition portal 100. The pocket is located proximate to where portal 100 attaches to apparel 10 and stores portal 100 when not in use. For the embodiment shown in FIG. 3A, the pocket may be disposed on one of pant legs 26 or a groin region of shroud material 15, for example. Elastic banding sewn into the pocket may be used to minimize the pocket size.

In one embodiment, an edge of openable flap 108 comprises a detachable attachment to shroud material 15 in a groin region of apparel 10. The detachable attachment 109 (FIG. 3A) may comprise a zipper, velcro or tape that permits opening and closing (sealing) of compartment 106. For a zipper 109, one side of the zipper is sewn into an edge of openable flap 108 while the other zipper side is sewn into shroud material in body portion 12 along a mating edge to flap 108. Tape 109 adheres flap 108 to shroud material 15 and may include a plastic tape disposed around periphery of flap 108, for example. Alternately, mating hook and loop fasteners may be disposed on flap 108 and shroud material 15 to detachably fix flap 108 during usage and close storage compartment 106.

In one embodiment, transition portal 100 comprises a flaccid material that allows the user to compress, scrunch, fold or otherwise minimize the volume of the material in transition portal 100. For example, the flaccid material allows a person to roll transition portal 100 along its tubular axis to decrease the diameter of the material, and then fold or roll the material into storage compartment 106. Alternatively, the flaccid material in transition portal 100 may be rolled normal to its tubular axis to and stored along the length of the arched storage compartment shown in FIG. 1. In general, the material in transition portal 100 may be collapsed into a volume to fit any shape for storage compartment 106. Once transition portal 100 is within storage compartment 106, flap 108 allows the person 11 to open and close (and seal in some cases) storage compartment 106. This also keeps both inside and outside surfaces of portal 100 protected from exposure to any undesirable agents during usage of apparel 10.

The tubular shape of transition portal 100 defines ends for aperture 107: a proximate aperture end 102 disposed at a proximate end of the tubular shape and a distal aperture end 104 disposed at a distal end of the tubular shape. Proximate aperture end 102 defines where transition portal 100 opens into apparel 10. In one embodiment, transition portal 100 material around proximate aperture end 102 is sewn to shroud material 15 along the edge of aperture end 102. As shown in FIG. 1, proximate aperture end 102 roughly matches the contour of flap 108. Transition portal 100 may attach to shroud material 15 at any location that allows person 11 to enter exit out of apparel 10 using aperture 107.

Distal aperture end 104 is disposed at a distal, or free, end of transition portal 100. Distal aperture end 104 defines the initial exit point for doffing apparel 10 (FIGS. 3C and 3E), and the initial entry point for donning apparel 10 through transition portal 100 (if portal 100 is also used for donning). Both aperture ends 102 and 104 provide an exit (and entrance) for protective apparel 10 during doffing (and donning). Each aperture end 102 and 104 includes a diameter suitable for a person to fit through. As will be described in further detail below, person 11 doffs apparel 10 by lifting distal aperture end 104 from the person's feet, upwards and over their body, and over their head. In one embodiment, the tubular height of transition portal 100 and distance between ends 102 and 104 may vary from about one inch to about four feet, depending for example on the location of attachment to shroud material 15. In another specific embodiment, the height of transition portal 100 ranges from about one foot to about two feet.

In one embodiment, transition portal 100 is sized such that it may contain apparel 10 for disposal. As will be described below, portal may be used to contain apparel 10 after doffing to facilitate discarding of a disposable apparel 10. This size of a disposal transition portal 100 will vary based on the amount, size and types of material in apparel 10, as one of skill in the art will appreciate. For example, the presence of a plastic viewing window 24 that is less compressible will occupy more space upon disposal and may motivate a larger disposal transition portal 100. The tubular height of a disposal transition portal 100 and distance between ends 102 and 104 may vary from about one inch to about four feet, depending on the amount of material in apparel 10, the location of attachment to shroud material 15, and the cross sectional area of portal 100 that combines with the height to form a total volume for a disposal transition portal 100. In another specific embodiment, the height of a disposal transition portal 100 ranges from about one foot to about three feet.

Each aperture may include a drawstring 110 that allows person 11 to control the aperture size of each aperture end. More specifically, drawstring 110*a* allows the user to change the aperture size for proximate aperture end 102, while drawstring 110*b* allows the user to change the aperture size for distal aperture end 104. In one embodiment, the material in transition portal 100 is folded back onto itself and sewn, or otherwise attached onto itself, to form a channel that continues circumferentially around each aperture. The drawstring 110 then passes through the channel, circumferentially around the aperture end, and out of two holes in the channel that are near each other, similar to designs used in many conventional garbage bags. This allows a user to cinch each end closed with the drawstring. FIG. 3A illustrates apertures 102 and 104 substantially relatively closed using drawstrings 110. FIG. 3B illustrates apertures 102 and 104 relatively opened.

Using drawstring 110, each aperture end 102 and 104 may be changed in size such that a) person 11 may fit through each aperture end during doffing (and doffing), and b) such that each end may be substantially closed. Closing each aperture end 102 and 104 allows further protection to prevent an undesirable agent from reaching the environment internal to apparel 10. Closing each aperture end 102 and 104 also allows person 11 to pack apparel 10 into transition portal 100 after donning to facilitate disposal, similar to a garbage bag with drawstrings at both ends.

In operation, transition portal 100 is typically collapsed and stored while person 11 wears apparel 10. When ready to doff, person 11 first releases transition portal 100 from its storage position within storage compartment 106 (moving from the apparel 10 shown in FIG. 1 to that shown in FIG. 3A). Releasing the detachable attachment 109 for flap 108 achieves this. If drawstrings are included and closed, person 11 may loose the drawstrings for aperture ends 102 and 104 (to arrive at the transition portal 100 shown in FIG. 3B). In one embodiment, portal 100 and stored within apparel 10 the apertures 107 open and the portal 100 is rolled during storage to seal the aperture. The person may extend distal aperture end 104 away from protective apparel 10. For the embodiment shown, gravity may assist the unrolling and unfolding of transition portal 100. At this point, transition portal 100 resembles a skirt dropping from the central portion of the groin region of person 11.

For the embodiment shown in FIGS. 3A-3E where apparel 10 includes pants 26, person 11 doffs apparel 10 by stepping out of pant legs 26 and into aperture 107 of transition portal 100. FIG. 3C illustrates person 11 with his legs in transition portal 100, with his feet 55 outside the transition portal 100. In this case, pant legs 26 and boots 60 are limp and lay to the sides of transition portal 100. In one embodiment, apparel 10 is designed to include sufficient space internal to shroud material 15 to allow person 11 to lift each leg high enough for insertion into proximate aperture end 102. The amount of space required for this will vary with the body of person 10 and the height of proximate aperture end 102. For a groin attached transition portal, proximate aperture end 102 has a height that equals the bottom surface of the lower surface of body portion 12, which as described above may vary from a height at the ankles of person 11 to the waist of person 11. In a specific embodiment, proximate aperture end 102 has a height to which the person lifts each leg according to the bottom or lowest edge of flap 108. As mentioned above, flap 108 may curve down pants 26 to a lowest location anywhere between the ankles and knees of pants 26. In some cases, flap extends to about the bottom of the calf. Loose fitting shroud material 15 may be manipulated to alter this height and reduce the height to which the person must lift their leg. More specifically, body portion 12 may be designed and configured to provide ample space between person 11 and shroud material 15 to allow the person to manipulate shroud material during doffing and move apparel 10 and change the height to which the person lifts each leg. The space within body portion 12 thus allows person 11 to lift each leg high enough for insertion within proximate aperture end 102.

In another embodiment, apparel 10 comprises an open bottom gown and no pants 26. The gown includes a body portion 12 that remains open at its bottom end. Typically, the gown bottom extends down (and the open bottom rests below) the person's thighs or below their knees when wearing apparel 10. A transition portal 100 may be attached to an inside surface of bottommost portions of the open gown. For example, a gown body portion 12 may extend down the torso and open at the person's knees, where the transition portal 100 is continuous with material in body portion 12 but folded inwards to rest internal to the gown during usage. When ready to doff, transition portal 100 is then unfolded or released from its internal storage position. Mating hook and loop fasteners may be used to maintain the internal folded position, for example. The user may detach the portal 100 and then extend the distal end 106 away from themselves to arrive at a situation that resembles FIG. 3C (minus pants 26). Alternatively, the bottommost portions of the gown may act as the transition portal. In this case, it is not stored internal to the apparel during usage. A drawstring and handles may also be attached to the bottommost portions of the gown to facilitate sealing and doffing as described below.

To continue doffing, person 11 grasps a distal portion of transition portal 100 and pulls transition portal 100 upwards. Notably, this turns transition portal 100 inside-out. Since protective apparel 10 attaches to transition portal 100 at proximate aperture end 102, all portions of protective apparel 10 eventually are pulled upwards with transition portal 100. Pulling transition portal 100 upwards also converts many portions of apparel 10 inside-out. For example, pulling transition portal 100 upwards may pull body portion 12, hood 20, sleeves 14 and gloves 40 (if attached) inside-out. Correspondingly, previously internal portions of apparel 10 that were not continuously exposed to undesirable agents now become the external surface of apparel 10 and transition portal 100.

Any portions of apparel 10 not turned inside-out but still attached to apparel 10 are eventually contained within the inside-out transition portal 100 and apparel 10 (FIG. 3E). For example, body portion 12, pant legs 26 and boots 60 will eventually be contained by the inside-out transition portal 100 and/or inside-out shroud material 15 of body portion 12. FIG. 3D illustrates person 11 lifting transition portal 100—and all attached portions of apparel 10—upwards and above the person's waist. In this case, pant legs 26 and boots 60 are limp and contained within a space 125 formed in transition portal 100 as the portal 100 is lifted upwards.

The person may initially grasp or pinch an outer surface 127 of transition portal 100 (an originally outer surface as shown in FIG. 3C) to lift transition portal 100 and apparel 10 upwards. At this point, the person may be wearing gloves 40 that were exposed to the undesirable agent and contact may be limited to outer surfaces of portal 100 and the contaminated gloves. After the portal has been pulled over the person's head and the transition portal 100 is inside-out, arms are removed from sleeves 14 and the person may handle apparel 10 without physical contact between the person and a surface of apparel 10 that was external during usage of the apparel.

In another embodiment, transition portal 100 includes a number of handles 115 on the initially outside surface of transition portal 100. Handles 115 are large enough to receive a hand (or may be designed for one or more fingers); and allow the user to pull and handle transition portal 100 with relative ease. Handles 115 may comprise thin strips of material (such as scraps of shroud material 15) sewn to transition portal 100 near the distal end 104. From one to five handles 115 may be employed. For example, four handles sewn at every 90 degrees allows a person to pull transition portal 100 from multiple sides and angles. Similarly, three handles sewn at every 120 degrees allows a person to pull transition portal 100 from multiple sides and angles. In another embodiment, a pull cord attaches to a rear portion of transition portal 100. The pull cord allows the user to reach over a shoulder and pull rear portions of transition portal 100 upwards, depending on where the pull chord attaches to a back portion of transition portal 100. The pull chord may also include a forked configuration in which a single chord attaches to a back portion of transition portal 100 at multiple points, thereby allowing the person to pull multiple locations of the backside of transition portal 100 with a single hand.

Doffing continues until transition portal 100 and apparel 10 is upwardly pulled over the head of person 11 and hood 20 fully separates from person 11. FIG. 3E illustrates transition portal 100 lifted above the person's head and encompassing all of apparel 10. Once the person's hands are free from sleeves 14 and gloves 40, he may grasp an inner surface 129 (an originally inner surface as shown in FIG. 3C, but becomes the outside surface of transition portal 100 after doffing begins and as shown in FIG. 3D) of transition portal 100 with a bare hand. Again, the inner surface has not been exposed to any contaminants or undesirable agents.

In one embodiment, all portions of protective apparel 10 that are continuously attached and either a) inside-out after doffing, or b) contained within the inside-out transition portal 100 and apparel 10. This advantageously locates and contains undesirable agents—that were initially on outer surface of apparel 10—inside the inside-out transition portal 100 and apparel 10. Since inner surfaces of apparel 10 were not continuously exposed to undesirable agents, conversion of transition portal 100 and apparel 10 to an inside-out state conveniently allows person 11 to manipulate and handle transition portal 100 and apparel 10 (after doffing) using the unexposed inner surfaces of apparel 10 and transition portal 100, thereby minimizing the risk of cross contamination. In this manner, transition portal 100 is configured to allow a person to doff apparel 10 without physical contact between the person and a surface of apparel 10 that was external during usage.

Inside-out doffing of transition portal 100 thus converts outer surfaces of apparel 10, which would have been potentially exposed to any undesirable airborne contaminants, to the inside of the doffed transition portal 100 and apparel 10. Since the hood 20 and apparel 10 is substantially sealed except for any filters, doffing in this manner also turns apparel 10 and transition portal 100 into a large 'garbage bag' whose outer surface is relatively free of any undesirable agents, thereby facilitating disposal of apparel 10. In addition, by manually closing aperture end 104, person 11 may also seal apparel 10 and any undesirable agents within the inside-out apparel 10 and transition portal 100. Person 11 may close aperture 104 using drawstring 110*b*, or by scrunching, twisting or tying the material of transition portal 100, for example. Person 11 may also fill or stuff portions of apparel 10 not currently in transition portal 100 immediately after doffing into transition portal 100; and then close proximate aperture end 102 using drawstring 110*b*. This converts apparel 10 into a compact form or garbage bag with ties at both ends to facilitate disposal of apparel 10.

Transition portal 100 thus allows person 11 to doff apparel 10 while minimizing physical contact between person 11 and an outside surface of apparel 10. Physical contact between person 11 and an outside surface of apparel 10 refers to contact between a surface of apparel 10 that was external during usage of the apparel and the skin of person 11 and/or clothes worn by person 11. An outside surface of apparel 10 in this sense may include any surface of apparel 10 that was exterior while wearing apparel 10 and potentially exposed to any undesirable agent. In this sense, both inner and outer surfaces of transition portal 100 are not considered outside surfaces of apparel 10 since they are both contained within storage compartment 106 while apparel 10 is worn and used by person 11. In other words, the outer surface of flap 108 forms an outside surface of apparel 10 that protects transition portal 100 from exposure to the ambient environment and potential contamination by an airborne or other undesirable agent. The amount of contact between person 11 and an outside surface of apparel 10, if any, will depend on how the person doffs the apparel. The design and configuration of transition portal 100 permits a person to doff apparel 10 without any contact between person 11 and an outside surface of apparel 10. However, it is understood that in some cases there may be limited contact between person 11 and an outside surface of apparel 10 such as if a person rushes and does not watch where they put a hand after removing it from sleeve 14.

In one embodiment, apparel 10 includes an identifier that differentiates inner surfaces of apparel 10 from outer surfaces of apparel 10. In this case, inner surfaces refer to surfaces of apparel 10 that are internal to apparel 10 during usage while outer surfaces refer to surfaces of apparel 10 that are outwardly visible and/or potentially exposed to an undesirable agent. In one embodiment, inner surfaces of shroud material 15 included in sleeves 14, pant legs 26, transition portal 100 and body portion 12 employ an identifier that differentiates these surfaces from outer surfaces of shroud material 15 in these areas. In a specific embodiment, the identifier is a color solely used on inner surfaces. For example, white may be used on the inner surfaces of sleeves 14, pant legs 26, transition portal 100 and body portion 12 to help the wearer determine which surfaces of apparel 10 are to be handled after they have removed their hands from sleeves 14 and gloves 40.

Apparel 10 may also include a second identifier that differentiates outside surfaces of shroud material 15 from inside surfaces of shroud material 15. For example, blue may be used on outside surfaces of shroud material 15 to help the wearer determine which surfaces of apparel 10 are to be avoided after they have removed their hands from sleeves 14 and gloves 40.

Thus, apparel 10 may be doubly marked with one identifier on inside surfaces and a second identifier on outside surfaces. A first color may then be used for all outer surfaces of apparel 10 while a second color is used for all inner surfaces. This translates into a simple scheme that facilitates doffing and inside-out methods of the present invention, such as 'white equals clean, blue equals dirty'. Marking apparel 10 in this manner greatly reduces uncertainty for practitioners doffing and disposing of apparel 10 since it readily and visibly informs them which surfaces have not been continually exposed during apparel usage and are intended for handling, and which surfaces have been exposed and are to be avoided.

Alternate identifiers used to distinguish inner surfaces from outer surfaces or outer surfaces from inner surfaces may include other colors, different types of materials that differentiate inner and outer surfaces, textures, and patterns for example. For many non-woven materials, a dual color or texture system may be achieved when shroud material 15 is a composite that comprises multiple layers of materials. For example, fabric/polymer/fabric composite materials may include different color fabrics employed in the composite to differentiate the inner and outer surfaces. In this case, individual layers of different colors may be combined with little added manufacturing cost or complexity. Alternatively, a composite may comprise a polymer/fabric combination where the user knows that the polymer was employed as the outer surface and only fabric is to be handled during doffing.

Although doffing has been described using transition portal 100 via a user grasping distal portions of transition portal 100, such as outer edges of distal aperture end 104, doffing using transition portal 100 may comprise manipulation of any portions of transition portal 100 that avoids cross contamination. For example, if drawstrings 10 are loosened by gloves 40 during doffing, cross contamination via the drawstrings is possible. In this case, the user may subsequently avoid drawstrings 10 after removing their hands from sleeves 14 and gloves 40. Alternatively, aperture ends 102 and 104 may be initially left open such that aperture ends 102 and 104 are open during storage in—and release from—storage compartment 106, thereby negating any need to touch drawstrings 10 with gloves 40. In this case, flap 108 may be opened by pulling an external surface of flap 108, which allows transition portal 100 to drop from compartment 106 (due to gravity and with some user assistance) with apertures 102 and 104 already open and ready for doffing.

While the present invention has been primarily described with respect to transition portal 100 arranged in a groin portion of apparel 10, advantages of the present invention described herein may also be achieved by locating transition portal 100 in other locations of apparel 10. For example, proximate aperture end 102 may attach to a back or front area of body portion 12, a neck portion of hood 20, for example. Locating transition portal 100 in an upper portion of apparel 10 allows gravity to assist doffing. Alternatively, proximate aperture end 102 and transition portal 100 may be arranged in the back of body portion 12 and allow the person to step into and out of apparel 10 from a back aperture.

Material used in transition portal 100 may comprise the same or a different material as that used for shroud material 15. Materials suitable for use as shroud material 15 were described above. In another embodiment, material used in transition portal 100 comprises a stretchable material, such as spandex or a cotton/lycra combination, which permits stretching and facilitates pulling of transition portal 100 over the person's body. Alternatively, transition portal 100 may include a material more suitable for disposal, such as a thin plastic used with conventional garbage bags that provides liquid impermeability. Seams used to attach transition portal 100 to apparel 10 may include sewing, taping, heat-sealing, adhesive and/or solvent or sonic welding. The specific joining technique used will depend on the two materials being joined, manufacturing ease and the desired joint strength, as one skilled in the art will appreciate. Multiple joining techniques may also be implemented, such as sewing for seal strength and heat-sealing for seal integrity.

Although the present invention has been described with respect to a particular garment assembly as described with respect to apparel 10 of FIG. 1, it is understood that transition portal 100 may be used with any protective apparel and is not limited to the specific design described above. For example, although apparel 10 has been described with respect to one particular headgear assembly 180, a wide variety of apparel that employ more complex headgear designs including fans are common in conventional surgical suits are suitable for use with the present invention. In addition, larger suits such as full protection suits for use in chemical, industrial and radiation protection may also benefit from the present invention. Some of these full-body chemical, industrial and radiation may not include headgear that supports shroud material 15 and rely on high pressure blowers that inflate the entire suit.

Figure 4A:
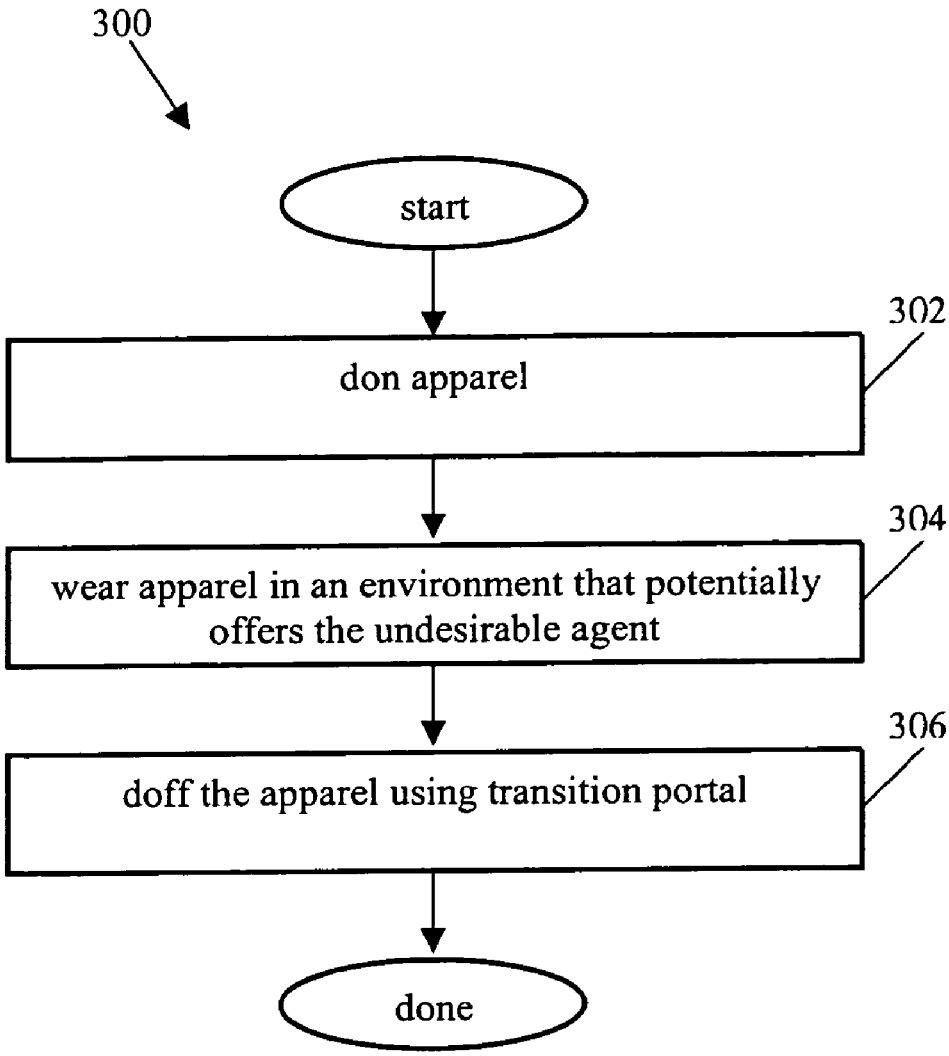
FIG. 4A illustrates a process flow for using apparel that protects a person from an undesirable agent in accordance with one embodiment of the invention.

FIG. 4A illustrates a process flow 300 for using apparel that protects a person from an undesirable agent in accordance with one embodiment of the invention. While the present invention will now be described as a methods and actions for donning, using and doffing protective apparel, those skilled in the art will recognize that the subsequent description may also illustrate protective apparel that permits the described method and actions.

Process flow 300 begins by donning protective apparel that protects the person from an undesirable agent (302). Donning the protective apparel using transition portal 100 is detailed below with respect to FIG. 4B, while suitable protective apparel is described above with respect to FIGS. 1 and 3A-3E.

In another embodiment, apparel 10 includes a back aperture employed for donning and dedicates the transition portal for doffing. Donning through the back aperture includes opening the back aperture, inserting legs into pants 26, inserting arms into sleeves 14 and a head into hood 20. For donning a gown through a back opening, donning may include navigating arms into the sleeves and a head into the hood and/or headgear. Ties or a zipper may be used to close the back aperture when donning is complete. A rope or chord attached to a back zipper allows a user to self-don without requiring assistance from another person to close the back zipper. The user may then further adjust a headgear assembly for fit, comfort and/or positioning of a viewing window relative to the person's face, as well as perform other donning actions for apparel 10 unrelated to transition portal 100 as described below for process flow 302 (e.g., steps 322, 326, 328 and 332). One advantage of a back aperture is that the protective apparel may be donned quickly in situations that call for rapid response, such as an emergency room. The protective apparel is also highly portable and allows for rapid donning in a variety of locations, such as a remote site traveled to by emergency care workers. The protective apparel is thus suitable for use by healthcare workers in a variety of locations such as spontaneous locations and specialized care units. Apparel 10 also allows for rapid self-growing in these environments.

Process flow 300 continues with the person wearing the apparel in an environment that potentially offers an undesirable agent (304). Undesirable agents may include gaseous or liquid agents, biological and/or chemical molecules, microorganisms, airborne contaminants that are in a gaseous, liquid or solid state, and other substances that the person wants minimal or no exposure to. Thus, health-care practitioners working in environments where biological agents are probable may benefit from wearing apparel described herein. Apparel 10 is well suited to defend against threats related to SARS, ebola, anthrax, flu, and other airborne or droplet based threats. Apparel 10 is also well suited for use in other environments such as those associated with chemical and industrial environments where user contamination is to be minimized or avoided.

In addition, the present invention also addresses the dual function of preventing transfer of undesirable agents from the person wearing the apparel to environments and persons outside the apparel. In this case, the apparel may include exhaust filters that filter air and particulates passing out from the apparel and is thus well suited for use by nurses and other practitioners in an operating room or surgical environment to prevent passage of undesirable agents from the practitioner to a surgery patient. Apparel 10 is also well suited for use in low contamination rooms and other places such as "clean rooms". The latter is common in the semiconductor industry where contamination contributions by occupants are to be avoided.

When finished with the protective apparel, the person then doffs the apparel using an aperture included in transition portal (306). Doffing the protective apparel is further described below with respect to FIG. 4C and above with respect to FIGS. 3A-3E.

Figure 4B:
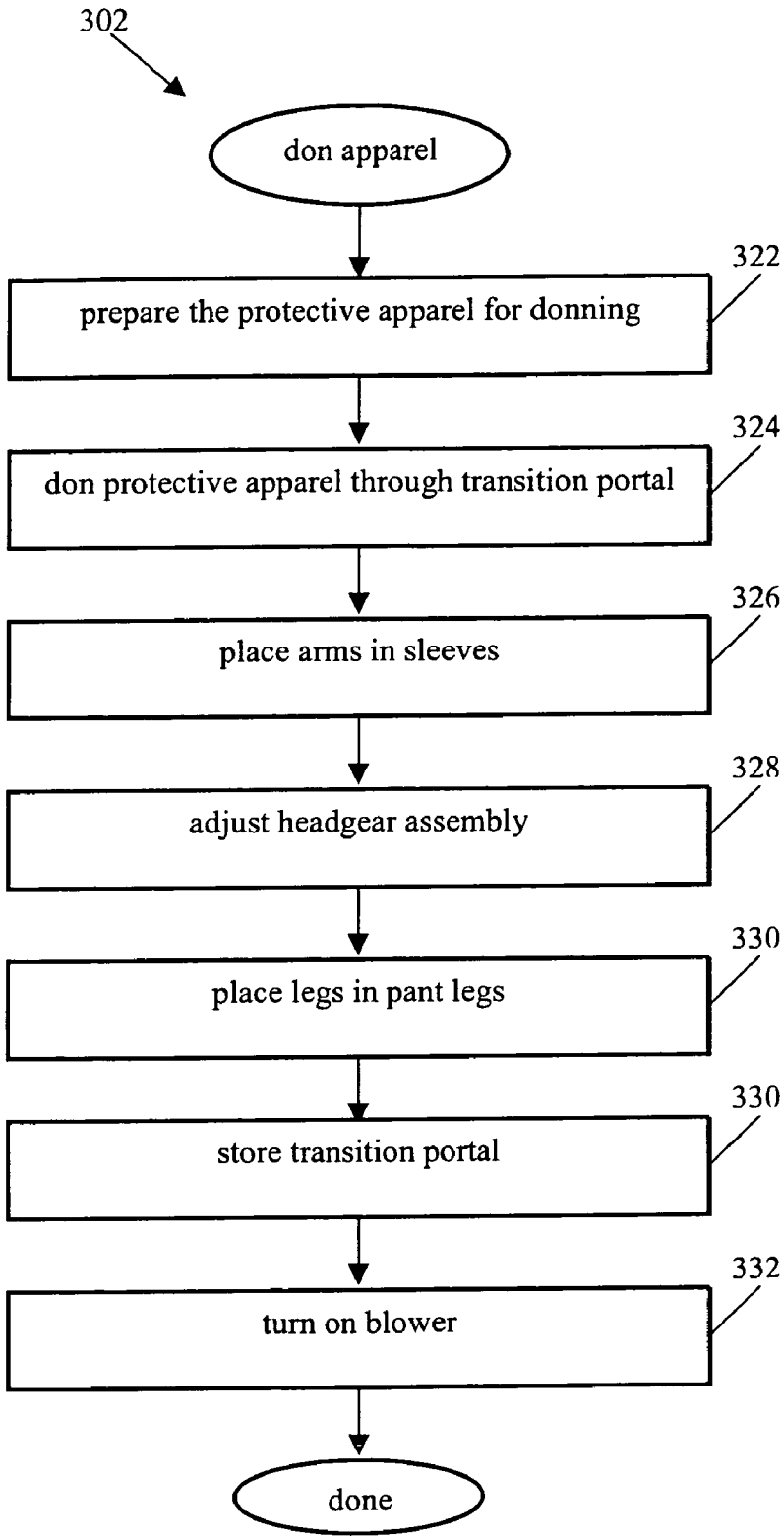
FIG. 4B illustrates a process flow for donning protective apparel in accordance with one embodiment of the invention.

FIG. 4B illustrates a process flow 302 for donning protective apparel using a transition portal in accordance with one embodiment of the invention (302 of process flow 300). As the term is used herein, donning refers to dressing or putting on clothing. In the healthcare practice, self-donning protective apparel is commonly referred to as self-growing.

Process flow 302 begins by preparing the protective apparel for donning (322). For transition portal donning, this may include withdrawing the transition portal 100, opening any aperture ends included in the transition portal 100 that are currently closed or not large enough for donning, and locating the entry of hood 20 inside body portion 12. The user first dons the protective apparel 10 through the aperture 107 of transition portal 100 at distal aperture end 104, similar to how they might put on a sweater (324). This may occur while the person stands. Once inside, the person navigates their head into hood 20. Once the person can see out from viewing window 24, the person may then proceed to place their arms in sleeves 14 (326).

In one embodiment, apparel 10 includes handwear attached to the end of each sleeve 14 that facilitates doffing. In this case, the user extends his arms through sleeves 14 into the handwear, adjusting for fit as desired. The person may then adjust headgear as desired (328), e.g., to position the viewing window 24 before donning gloves. Gloves, such as conventional latex disposable gloves, may then be added to each hand. The user may also apply a tape to attach the disposable gloves to sleeves 14. Upon removal of apparel 10, the gloves are attached to sleeves 14 via the tape and may be pulled off when the apparel is pulled inside-out.

The user may then further adjust a headgear assembly for fit, comfort and/or positioning of a viewing window relative to the person's face (328). This typically comprises positioning a hood of the apparel such that a portion of a viewing window included in the hood is arranged in front of the person's face when the person wears the apparel. The user also inserts each leg into a pant leg (330). For the groin attached transition portal 100 described above, the user inserts each leg into a pant leg by lifting a leg out of transition portal 100 and then inserting a leg, foot first, into a pant leg 26 (330).

The protective apparel allows the person to store the transition portal 100 in a designated storage area (332). The user may minimize encumbrance of the transition portal before storage, e.g., folding, rolling, or otherwise reducing and packing the volume of transition portal 100 to fit in a designated storage area. As described above, body portion 12 may comprise a gown that extends down to the mid thigh of the person, thereby providing storage space below the groin. In another embodiment, transition portal 100 may be compressed and rolled along its tubular axis and then placed down one of pant legs 26. Alternatively, a pocket may be included on an inner side of one of the pant legs to store the transition portal. Storage also includes closing the storage compartment using an outer flap, if necessary. Pockets and storage spaces may also be closed and sealed using an adhesive tape, a zipper, or the like. In another embodiment, the transition portal is not stored and the person closes an end of the aperture using a drawstring to seal the interior of the apparel from the environment external to the apparel.

Donning process flow 302 proceeds by securing a blower near filter 30 and turning on the blower (332), e.g., by attached hook and loop fasteners on a fan to mating fasteners on shroud material 15 and plugging the fan into a power source such as a rechargeable dc battery. Initially, the rate of air influx through the inlet filters and into the apparel may exceed the rate of air out flux through the outlet filters. As interior pressure increases, the rate of air out flux will increase with increasing interior pressure, while the rate of air influx will decrease as interior pressure increases. Eventually, a relative pressure and airflow balance is achieved.

The user may also adjust apparel 10 for fit. This may include, for example, securing excess material such as that found at the distal end of pant legs 26 and boots 60 with ties or elastic used in these areas (FIG. 1) or tying a waist belt if included. While donning process flow 302 has been described with respect to an exemplary donning order to facilitate illustration, it is understood that some users may change the order of the individual actions listed above as desired. For example, some users may prefer to insert and turn on the blower before storing the transition portal, while other users may adjust headwear after placing legs in pants, and so on.

Figure 4C:
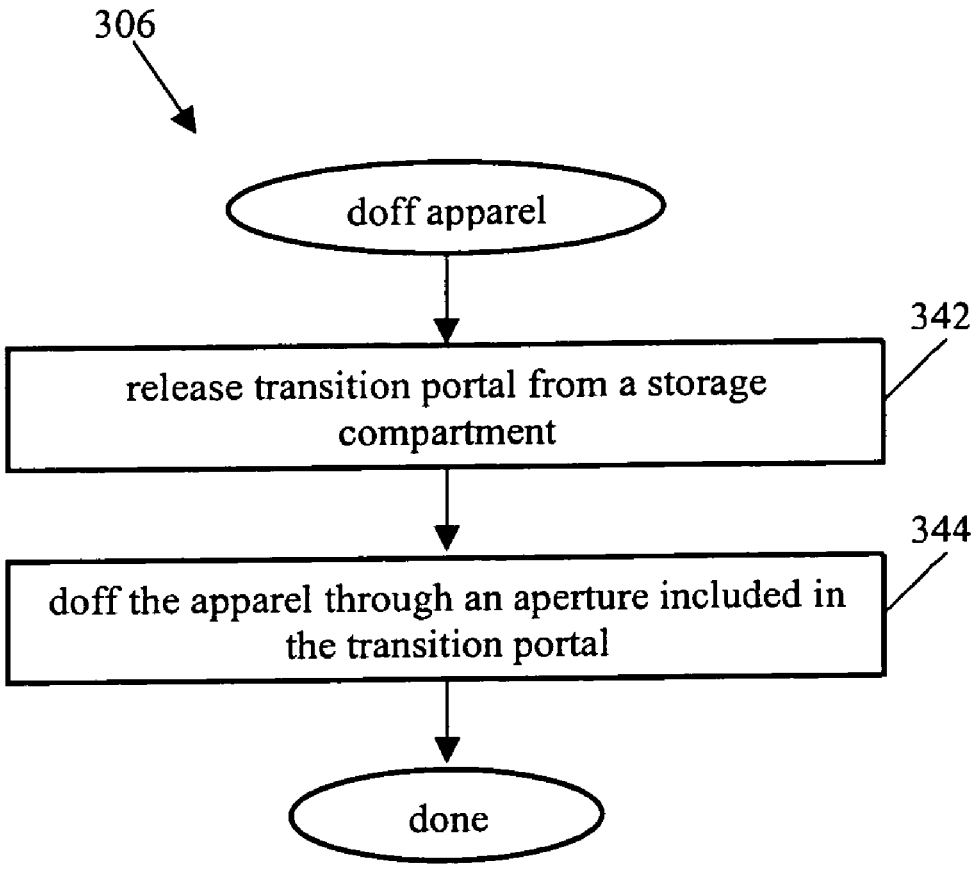
FIG. 4C illustrates a process flow for doffing protective apparel in accordance with one embodiment of the invention.

FIG. 4C illustrates a process flow 306 for doffing protective apparel in accordance with one embodiment of the invention (306 of process flow 300). As the term is used herein, doffing refers to divesting, undressing or removing clothing. Apparel provided herein employs a transition portal to assist doffing and to reduce the risk of cross-contamination when doffing. The transition portal connects to the apparel proximate to one end of an aperture included in the transition portal. The aperture provides an exit between an environment internal to the apparel and an environment external to the apparel, which may be opened and closed by the wearer.

Process flow 306 begins by releasing a transition portal from a storage compartment (342). In one embodiment, the transition portal is contained in a storage compartment that includes an outer flap secured by a zipper. To begin doffing, the person unzips the zipper, opens the flap and releases the transition portal, which may include unrolling or unfolding the transition portal. The user may also open an aperture included in the transition portal that is eventually sized such that the person may fit through the aperture. If drawstrings are used to control the aperture size of any part of the aperture, a user loosens each drawstring to open the aperture. In another embodiment, apparel 10 comprises an open gown and the transition portal is folded up into an inner surface of the gown. In this case, proximate end 104 of transition portal attaches to the lowest point of the gown and the person releases portal 100 by unfolding it from its storage position.

Doffing process flow 306 proceeds by doffing the apparel through the aperture, which may occur without physical contact between the person and an outside surface of the apparel (344). In one embodiment, apparel 10 comprises pants and the transition portal is stored in a groin area internal to apparel 10. When released from storage in a groin area, the transition portal falls from the lowest point of attachment, e.g., about the calves of pants 26 for apparel 10 of FIG. 1. The person then lifts their leg past this lowest point of attachment to step into transition portal 100. For a gown apparel 10, the person does not need to step out of pant legs 26 and into the portal, as they are already standing in the portal.

In a specific embodiment, the transition portal is then pulled upwards towards the person's head and over the person's body along with any attached portions of the protective apparel. One or more handles on the transition portal may aid a person in pulling the transition portal upwards. This turns the transition portal—and attached parts of the apparel worn during doffing—inside-out. For example, pant legs, sleeves and the main body of the apparel may be pulled inside-out. The transition portal may be pulled over the person's head to fully escape apparel 10. Arms may then be withdrawn from sleeves and gloves, potentially turning these inside out as well. After doffing, all portions of protective apparel are either a) inside-out after doffing, or b) contained within the inside-out transition portal and apparel material. As a result, undesirable agents—that were initially on the outside of the apparel—are now inside the transition portal and apparel.

Since apparel 10 is substantially sealed except for any filters, inside-out doffing turns apparel 10 and transition portal 100 into a bag whose outer surface has not been continually exposed to any undesirable agents. The person may also fill (push, stuff, etc.) portions of apparel not currently within transition portal immediately after doffing into the transition portal. For example, since hood 20 is likely the last portion of apparel 10 to be removed, person 11 may stuff hood 20 into the inside-out transition portal to contain all parts of apparel 10 in the portal and facilitate disposal of apparel 10. Drawstrings at the ends of the transition portal allow the user to enclose all portions of the apparel within the inside-out transition portal 100 and seal the portal on both ends. Disposal of the apparel may then occur while it is contained entirely in transition portal 100.

In one embodiment, apparel 10 comprises a first identifier or color (e.g., green) disposed on inner surfaces of shroud material 15 included in body portion 12, transition portal 100 and sleeves 14. The first identifier or color differentiates inner surfaces of shroud material 15 from outer surfaces of the shroud material. Doffing then includes handling inner surfaces of shroud material 15 that are marked with the first identifier or color—after the person has removed their arms from sleeves 14 and their hands from gloves 40. Apparel 10 may also comprise a second identifier or color (e.g., red) disposed on outer surfaces of the shroud material 15. Doffing according to the present invention then avoids contact between the person and these outer surfaces of the shroud material 15 after the person has removed their arms from sleeves 14 and their hands from gloves 40. Before the person has removed their arms from sleeves 14 and their hands from gloves 40, however, doffing may use the outer surfaces and keep contaminants on the hands localized to these outer surfaces.

Inside-out doffing as described in process flow 306 is advantageous since any undesirable agents such as airborne biological agents on the outside of apparel are now contained within inside-out apparel 10 and transition portal 100. By closing any outside transition portal apertures, such as by twisting a free end or using a drawstring, a person may then seal any contaminants within transition portal 100. Any contaminants trapped in the transition portal 100 may then be readily discarded.

Figure 4D:
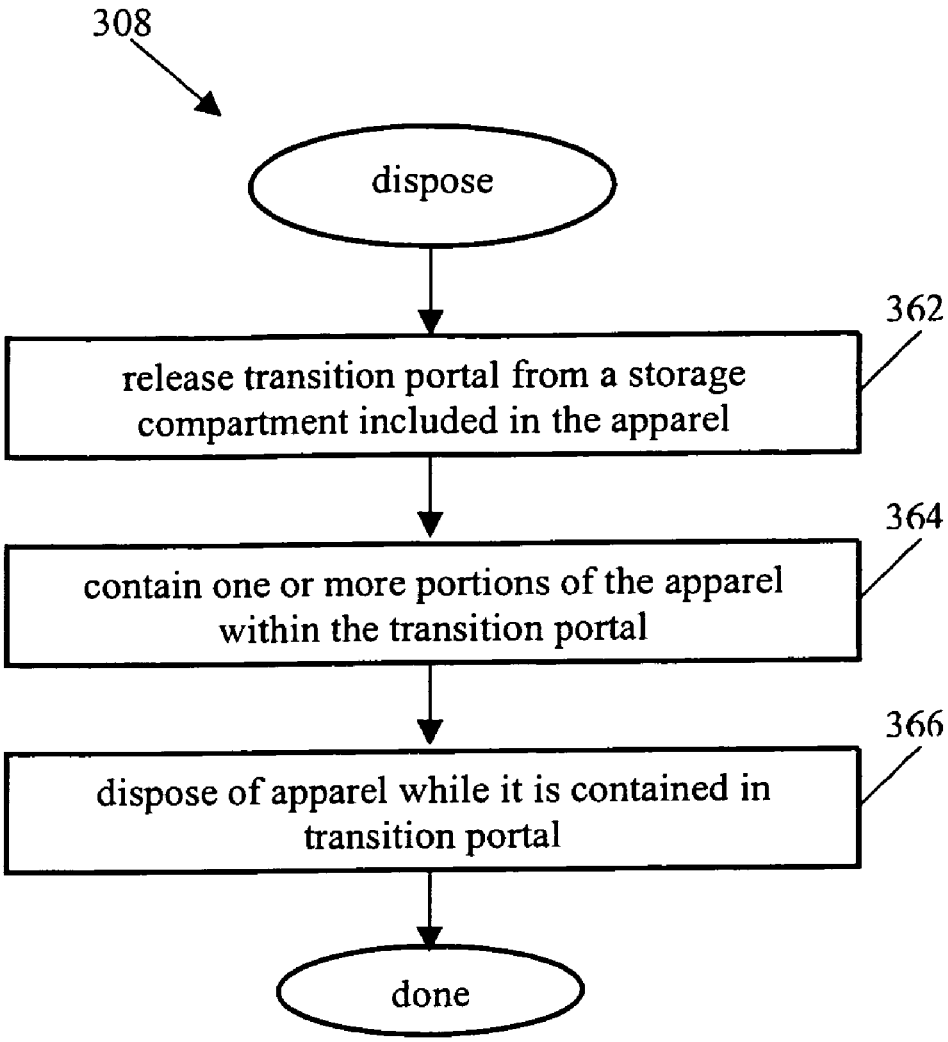
FIG. 4D illustrates a process flow for disposing of protective apparel using a transition portal in accordance with one embodiment of the invention.

Since apparel 10 is substantially sealed except for any filters, inside-out doffing turns apparel 10 and transition portal 100 into a bag whose outer surface has not been continually exposed to any undesirable agents. FIG. 4D illustrates a process flow 308 for disposing of protective apparel using a transition portal in accordance with one embodiment of the invention. As the term is used herein, disposing refers to discarding or throwing away of apparel. In healthcare applications for example, it is common for equipment to be disposed after a single use.

Process flow 308 begins with releasing a transition portal from a storage compartment included in the apparel. One embodiment of releasing and using transition portal 100 for inside-out doffing was described above with respect to 342 of process flow 306. In another disposal embodiment for transition portal 100, the apparel is doffed through a back aperture (or otherwise located in apparel 10) and a disposal transition portal 100 is withdrawn from a storage location after the person has escaped the apparel. The person may then contain (fill, push, stuff, etc.) portions of apparel not currently within the transition portal immediately after doffing into the transition portal (364). For example, since hood 20 is likely the last portion of apparel 10 to be removed, person 11 may stuff hood 20 into the transition portal to contain all parts of apparel 10 in the portal and facilitate disposal of apparel 10. Sleeves 14, pants 26 and body portion 15 may also be pushed or folded into transition portal 100. Drawstrings at the ends of the transition portal allow the user to enclose all portions of the apparel within the disposal transition portal 100 and close or seal the transition portal on both ends. Disposal of the apparel may then occur while it is contained entirely in the transition portal (366).

In one embodiment, apparel 10 is disposable. In some cases, all portions of apparel 10 are disposable except the blower, its associated power source and the headgear assembly. These parts may be separated before disposal. Disposable apparel benefits health care environments and hospitals since practitioners may rid of contaminated materials readily. In addition, disposable apparel offers increased portability to remote environments.

Although the foregoing invention has been described in some detail for purposes of clarity of understanding, those skilled in the art will recognize that various modifications may be made within the scope of the appended claims. For example, although the present invention has been described with respect to a garment assembly that provides full body coverage, one of skill in the art will appreciate that advantages of the present invention may be realized in a suit that covers less than the entire body. In addition, apparel 10 may also be reusable. In this case, apparel 10 may be cleansed of known undesirable agents such as biological agents with a bath in chlorine, for example. Further, for embodiments where the transition portal comprises bottommost portions of a gown, doffing the transition portal may excluse releasing it from a storage compartment or opening the aperture but still comprises pulling the portal upwards towards the person's head and over the person's body. The invention is, therefore, not limited to the specific features and embodiments described herein and claimed in any of its forms or modifications within the scope of the appended claims.

What is claimed is:

1. A protective suit comprising:

a body portion for covering at least a portion of a person's torso when the person wears the suit, a sleeve for receiving a portion of a right arm of the person, and a second sleeve for receiving a portion of a left arm of the person; and a disposal portal including a flaccid material that defines a first aperture end and a second aperture end, the first aperture end disposed proximate to a first end of the disposal portal where a portion of the disposal portal attaches to a portion of shroud material included in the suit, wherein the disposal portal is sized to substantially contain the protective suit for disposal, and wherein the disposal portal is located below the waist of the person when then person wears the suit and included in a transition portal configured to permit a person to doff the suit using the transition portal.

2. The suit of claim 1 wherein the disposal portal is collapsible and the suit comprises a compartment sized to store the disposal portal while the person wears the suit.

3. The suit of claim 1 wherein the disposal portal is stored in a pocket while the person wears the suit.

4. The suit of claim 1 wherein the disposal portal attaches to the shroud material about the entire perimeter of the aperture at the first aperture end.

5. The suit of claim 1 wherein the disposal portal comprises a first drawstring, disposed perimetrically about the second aperture end, which allows the person to change aperture size for the second aperture end.

6. The suit of claim 5 wherein the second aperture end may be substantially closed using the first drawstring.

7. The suit of claim 5 further comprising a second drawstring, disposed perimetrically about the first aperture end, which allows the person to change aperture size for the first aperture end.

8. The suit of claim 1 wherein the disposal portal attaches to shroud material included in the body portion.

9. The suit of claim 1 wherein the transition portal is sized such that the person may fit through the transition portal.

10. A protective suit comprising:

a body portion for covering at least a portion of a person's torso when the person wears the suit, a sleeve for receiving a portion of a right arm of the person, and a second sleeve for receiving a portion of a left arm of the person; and a disposal portal including a flaccid and substantially tubular material that defines a first aperture end and a second aperture end, the first aperture end disposed proximate to a first end of the disposal portal where a portion of the disposal portal attaches to a portion of shroud material, wherein the disposal portal is sized to substantially contain the protective suit for disposal, wherein the disposal portal is included in a transition portal configured to permit a person to doff the suit using the transition portal and the transition portal is sized such that the person may fit through the transition portal, and wherein the disposal portal is collapsible and configured to be stored internal to the suit while the person wears the suit.

11. The suit of claim 10 wherein the suit comprises a compartment sized to store the disposal portal while the person wears the suit.

12. The suit of claim 11 wherein the compartment is arranged in a groin region internal to the suit.

* * * * *